US010588420B1

(12) United States Patent
Krenik

(10) Patent No.: US 10,588,420 B1
(45) Date of Patent: Mar. 17, 2020

(54) ELECTRONICALLY CONTROLLED SLAT BED AND METHOD OF OPERATION THEREOF

(71) Applicant: Matthew W. Krenik, Garland, TX (US)

(72) Inventor: Matthew W. Krenik, Garland, TX (US)

( * ) Notice: Subject to any disclaimer, the term of this patent is extended or adjusted under 35 U.S.C. 154(b) by 0 days.

(21) Appl. No.: 15/615,397

(22) Filed: Jun. 6, 2017

Related U.S. Application Data

(60) Provisional application No. 62/452,469, filed on Jan. 31, 2017.

(51) Int. Cl.
*A47C 27/14* (2006.01)
*A47C 31/12* (2006.01)
*A47C 19/02* (2006.01)

(52) U.S. Cl.
CPC ..... *A47C 31/123* (2013.01); *A47C 19/027* (2013.01)

(58) Field of Classification Search
CPC ..... A47C 27/14
USPC ..... 5/236.1, 239, 934–935
See application file for complete search history.

(56) References Cited

U.S. PATENT DOCUMENTS

2015/0351982 A1* 12/2015 Krenik ..... A47C 23/06 5/616

* cited by examiner

*Primary Examiner* — Fredrick C Conley
(74) *Attorney, Agent, or Firm* — Eldredge Law Firm

(57) ABSTRACT

An electronically controlled slat bed includes a bed frame; slats together at least partially forming a base for a sleeping surface; struts coupled to the slats, and each strut coupled to said bed frame; jackscrews, each coupled to at least one strut to adjust the coupled strut; flexible apparatuses coupled to one of said jackscrews; a gantry coupled to said bed frame, the gantry having an electric motor; and a sensor; the motor is to engage and rotate the jackscrews; and said sensor is to provide a measurement of a deflection of the flexible apparatuses; and an electronic controller, having an input to receive signals from the sensor; and one or more outputs to control said electric motor; said electronic controller performs computations at least partially responsive to said measurement of the deflection of said flexible apparatuses and modifies the shape of said base for the sleeping surface by rotating one or more of the plurality of jackscrews; and the deflection of one of the flexible apparatuses is responsive to a weight load applied to one of the jackscrews coupled to one of the flexible apparatuses.

23 Claims, 22 Drawing Sheets

ELECTRONICALLY CONTROLLED SLAT BED AND METHOD OF OPERATION THEREOF

CROSS REFERENCE TO RELATED APPLICATIONS

This application claims the benefit of U.S. Provisional Application Ser. No. 62/360,761, filed by Matthew W. Krenik on Jul. 11, 2016 and entitled "Electronically Controlled Slat Bed and Method of Operation Thereof"; and U.S. Provisional Application Ser. No. 62/452,469, filed by Matthew W. Krenik on Jan. 31, 2017 also entitled "Electronically Controlled Slat Bed and Method of Operation Thereof"; both commonly owned with this application and incorporated herein by reference.

BACKGROUND

Field of the Invention

Embodiments of this invention relate to improved beds for human sleeping.

Description of Prior Art

It is very well-established that good quality, restful sleep is essential to good overall health and well-being. And so, it is not surprising that very many technologies to improve the comfort and utility of beds have been introduced for many years. Spring mattresses and box springs, air mattresses, foam mattresses, viscoelastic foam mattresses, water beds, and beds utilizing combinations of techniques are all commonly available. However, in spite of the very wide variety of beds available, serious shortcomings exist for all types. Spring mattresses sag and become contaminated and/or infested with bugs over time. Water beds are heavy, cause problems if water leaks, and are not comfortable for many persons. Air mattresses lack ventilation and suffer from poor comfort. Foam mattresses are heavy, often lack ventilation, and also become dirty over time. Lack of a good system for cleaning beds is also a serious issue, as most mattresses and box springs cannot be easily cleaned or laundered.

Another issue with most available beds is that while they may be well-tailored to persons of specific height, weight, and body shapes, persons of different body size and shape may find them uncomfortable. This limitation results in many persons not sleeping well, as a given bed with existing technology, may not fit them well. And lack of a way to adapt a bed to a given person means that stores that sell bedding must stock a wide variety of beds and/or mattresses so that persons may try many of them in hopes of selecting a bed that fits them well. This lack of a bed design that is comfortable for all persons also makes it difficult to sell beds and bedding over the internet as each person needs to try each bed to ensure they select one that is good for them.

Use of more advanced technology to improve bedding and sleep have been proposed. Application Publication 2007/0239370 by Block (hereinafter "Block") proposes a bed with adjustable firmness/stiffness that utilizes a gantry to access and control an array of cylinders and to read sensors on those cylinders via an electrical connector. And Application Publication 2012/0137444 by Wong (hereinafter "Wong") proposed a bed surface with adjustable shape through manual control by a bed user or bed occupant. Regrettably, Block has serious shortcomings in lack of a way to sense if a user is sleeping on their back, side, front, or other position; and also requires a large number of cylinders to provide a smooth surface (leading to high costs, weight, inconvenience, etc.). Block also requires a very large number of sensors that must be individually mounted to each cylinder and be accessed through electrical connections. Alternatively, Block proposes measuring air pressure in his cylinders through action of his gantry, but this appears to be a slow process and it would be problematic to operate such a large pneumatic system without air leaks (that would cause objectionable noise). Finally, Block only provides a bed surface with adjustable firmness/stiffness and does not teach a system of creating a shaped or contoured sleeping surface. Hence, Block cannot provide benefits of elevating legs, shoulders, or other body parts, of providing a slanted, tilted, or twisted sleeping surface, or of cradling a bed occupant's body. And as Wong does not teach controls that are automatically responsive to a bed occupant, bed occupants who change their position in the course of sleep are not well-accommodated as they must wake up, re-adjust their bed's shape, and then try to re-gain sleep each time they change their sleeping position.

Some technologies exist for monitoring the weight distribution and weight load of a bed occupant applied to a conventional bed. These techniques involve placing a sensing pad or membrane above or below a conventional mattress and monitoring pressure using an array of sensors. And while pressure profiles of a bed occupant on a sleeping surface may be generated this way, there are considerable limitations due to close proximity to a bed occupant. In particular, the need to provide electrical safety in the face of possible release of bodily fluids, or other fluids, and the need to provide ventilation for comfort of the bed occupant make design of these sensing pads challenging and expensive. Additionally, it is difficult to provide consistent force or pressure measurements through a pad placed on top of, or between, mattresses and box springs that are compliant by design.

Patent application Ser. No. 14/730,666 filed by Matthew W. Krenik on Jun. 4, 2015 and entitled "Automated Bed and Method of Operation Thereof", hereinafter Krenik '666, teaches valuable techniques including the implementation of beds utilizing sensors and analysis techniques to sense whether a bed occupant is sleeping on their back, front, side, or other position and actuators to control a bed surface specific to the needs of a bed occupant. Krenik '666 also teaches use of bed slats adjusted by gantries to reduce costs and complexity, determining sleeping position using sensors coupled to slats, sending signals from a bed occupant to a bed through applying momentary pressure to a bed surface, and additional beneficial techniques.

It is very clear from the broad attention paid to beds and bedding (numbers of stores that advertise and sell bedding, wide range of bedding products available, etc.) that new techniques for beds and bedding are highly desired. This patent extends the teaching of Krenik '666 and offers multiple new and important techniques to make electronically controlled beds safer, cheaper and easier to build, and perform better for bed occupants.

SUMMARY

A first aspect of this patent application teaches an electronically controlled slat bed that comprises a bed frame; and a plurality of slats that, taken together, at least partially form a base for a sleeping surface. The bed also comprises a plurality of struts, in which each strut couples to at least one of the slats and also to the bed frame; and a plurality of jackscrews that couple to the struts, the jackscrews configured to adjust the struts they are coupled to. A plurality of flexible apparatuses are also coupled to each of the jackscrews. The bed further comprises a gantry that is coupled to the bed frame and includes an electric motor configured to engage and rotate at least a subset of the jackscrews. The gantry also comprises a sensor configured to provide a measurement of a deflection of at least a subset of the flexible apparatuses. And the bed further comprises an electronic controller that has an input to receive signals from the sensor and one or more outputs to control the electric motor. With this configuration, the controller may adjust the base for a sleeping surface formed by the plurality of slats, through rotation of the jackscrews, based at least partially on the measurements it receives of the deflection of the flexible apparatuses. And the deflection of one of the plurality of flexible apparatuses is responsive to a weight load applied to one of the plurality of jackscrews coupled to one of the plurality of flexible apparatuses.

A second aspect of this patent application teaches an electronically controlled slat bed that comprises a bed frame and a plurality of slats that together at least partially form a base for a sleeping surface. A plurality of struts each couple to at least one of the slats and to the bed frame; and the struts are individually adjustable so that a position of each of the plurality of slats may be adjusted. The bed further comprises a first gantry, the gantry coupled to the bed frame and the gantry comprising an electric motor and a sensor. The electric motor is configured to engage and adjust at least a subset of the struts. And the sensor is configured to provide a measurement of a weight or pressure applied to a slat. The bed further comprises an electronic controller that has an input to receive signals from the sensor and one or more outputs to control the electric motor. And the controller, during a first time interval of operation of the bed, controls the gantry to a position in which the sensor is responsive to skeletal movements of a bed occupant.

A third aspect of this patent application teaches an electronically controlled slat bed that comprises a bed frame, a plurality of slats that together at least partially form a base for a sleeping surface, and a plurality of individually adjustable struts that are each coupled to a slat so that a position of each coupled slat may be adjusted. The bed further comprises an electronic controller having an input to receive signals from one or more sensors that provide indications of a weight load applied to each of the slats, and one or more outputs to control the plurality of struts. The bed further comprises a head platform coupled to the bed frame by a mounting apparatus. The head platform is configured to hinge upwards on one side, or break away from the mounting apparatus, if at least a predefined level of upward force is applied to the head platform.

DRAWING FIGURES

The figures in this patent application are not necessarily drawn to scale.

Figure 5:
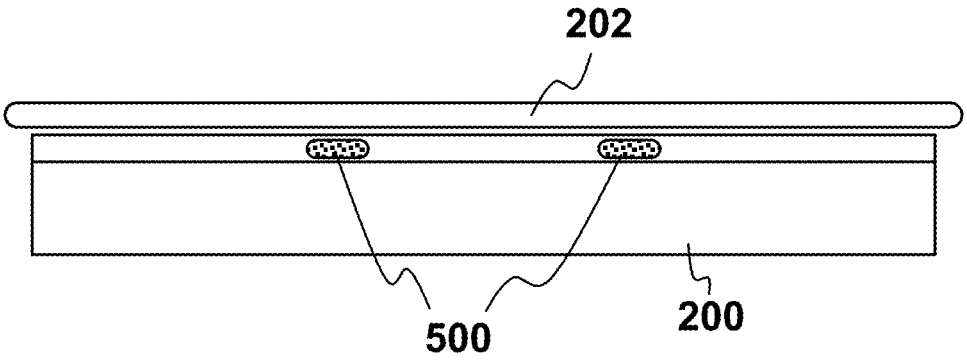

FIG. 5 shows a side view of an embodiment of a slat that includes bumpers placed between a rocking top section of a slat and a rigid bottom section of the slat to limit motion of the rocking top section so that persons are protected from pinching their fingers or other body parts. The bumpers may be positioned away from the ends of the slats so that it is unlikely a person would have their fingers or other body parts between the rocking top portion of the slat and the bumper.

Figure 6:
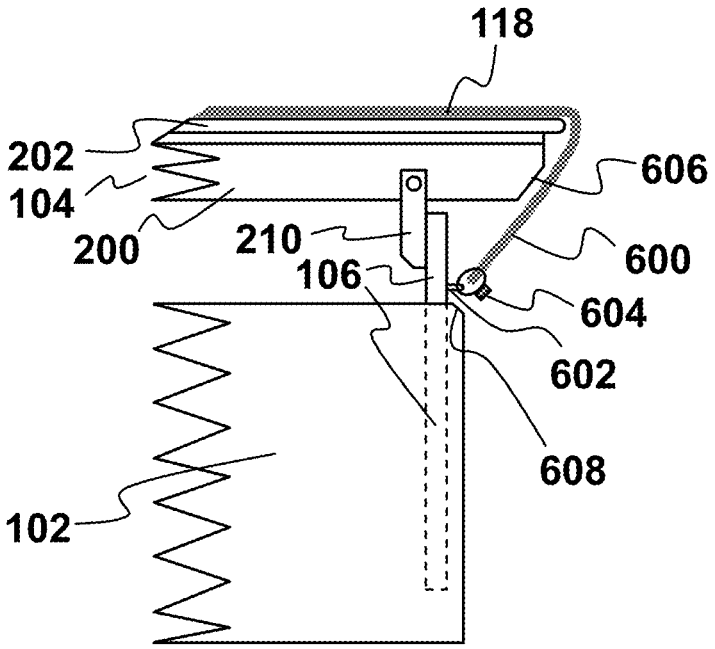

FIG. 6 shows a view of a portion of an embodiment of a bed frame, slat, and bed covering for an electronically controlled slat bed. In the embodiment of FIG. 6, a bed covering side flap is secured to the struts supporting the bed's slats to shield the moving portions of the bed from a person's fingers and other body parts.

Figure 7:
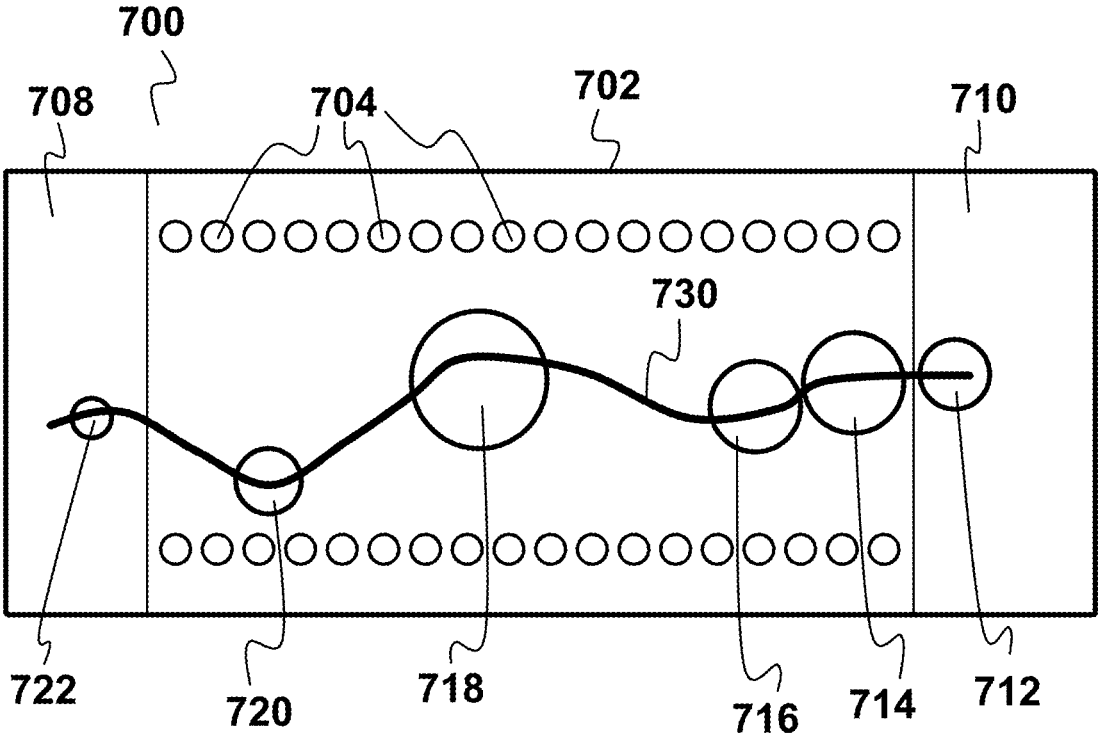

FIG. 7 shows a graphical view of force measurements that may be generated from a person lying on an electronically controlled slat bed. The view of FIG. 7 corresponds to a person lying on their left side.

Figure 8A:
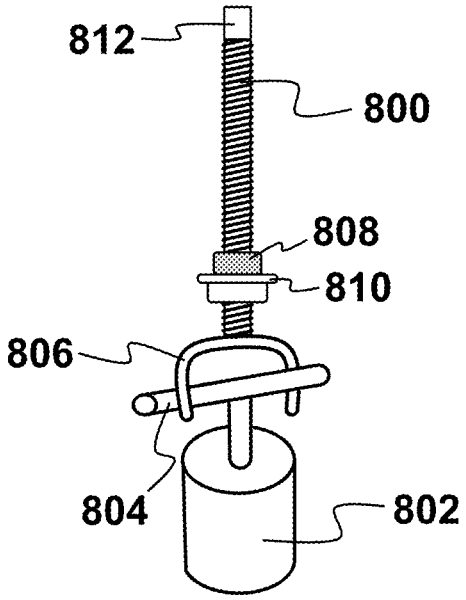

FIG. 8A shows a view of an embodiment of a motor with a T-coupler affixed to its shaft, that is coupled to a yoke affixed to a jackscrew. The jackscrew includes a smooth portion on one end, a retainer, and a bearing.

Figure 8B:
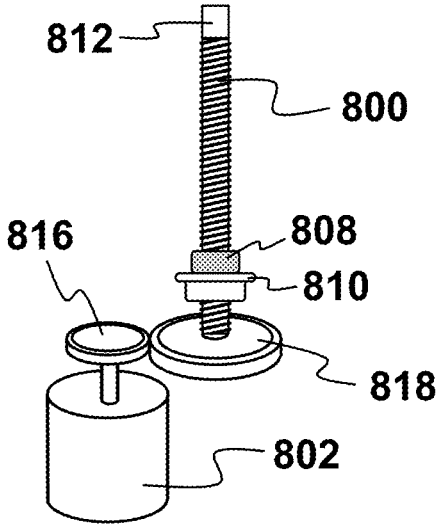

FIG. 8B shows a view of an embodiment of a motor with a first wheel affixed to its shaft, that is coupled to a second wheel affixed to a jackscrew. The jackscrew includes a smooth portion on one end, a retainer, and a bearing.

Figure 8C:
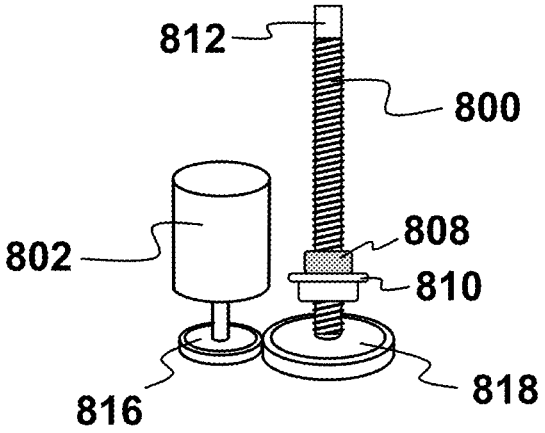

FIG. 8C shows a view of an embodiment of a motor with a first wheel affixed to its shaft, that is coupled to a second wheel affixed to a jackscrew. In the embodiment of FIG. 8C, the motor is placed alongside the jackscrew so that the overall height of embodiment may be reduced. The jackscrew includes a smooth portion on one end, a retainer, and a bearing.

Figure 9:
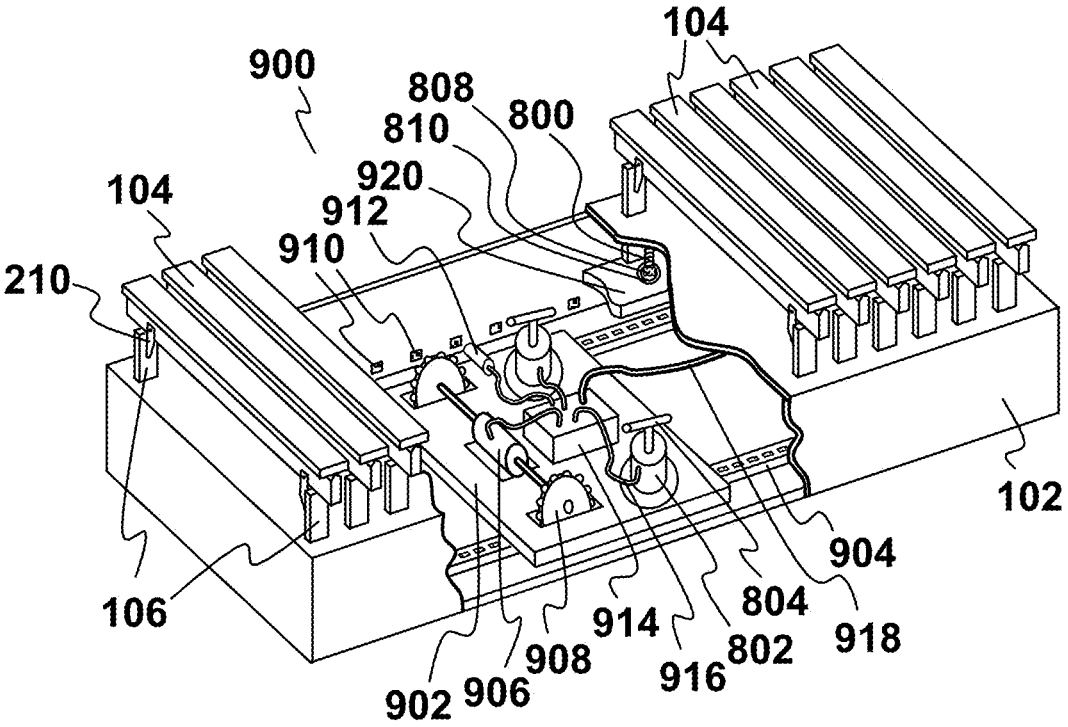

FIG. 9 shows a perspective cut-away view of an embodiment of a gantry in an electronically controlled slat bed. The gantry may be controlled to adjust the struts of the slat bed so that the slat bed may conform to a person lying on it.

Figure 10:
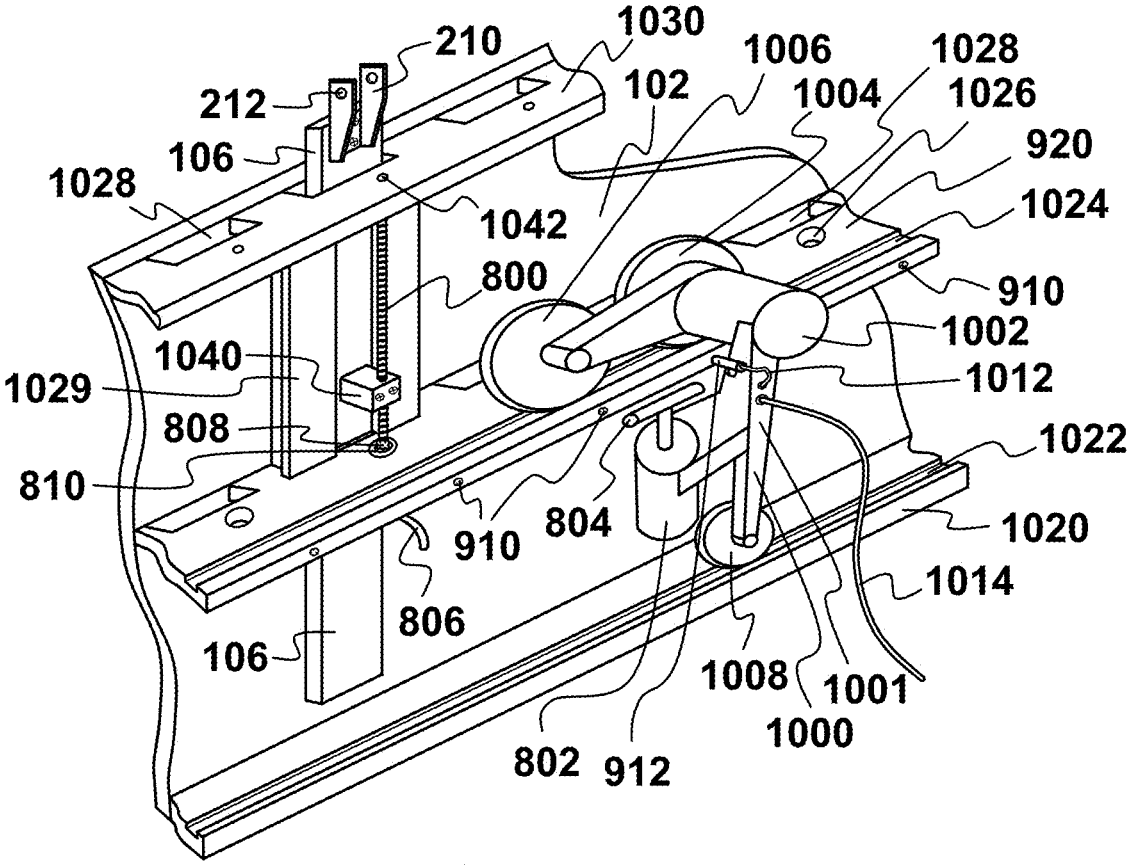

FIG. 10 shows a perspective view of an embodiment of the inside of a bed frame for an electronically controlled slat bed including a single bed-side gantry. The embodiment shown in FIG. 10 shows a strut including a jackscrew in which the jackscrew includes a yoke that may be engaged by a T-coupler and drive motor on the gantry so that the strut may be adjusted.

Figure 11A:
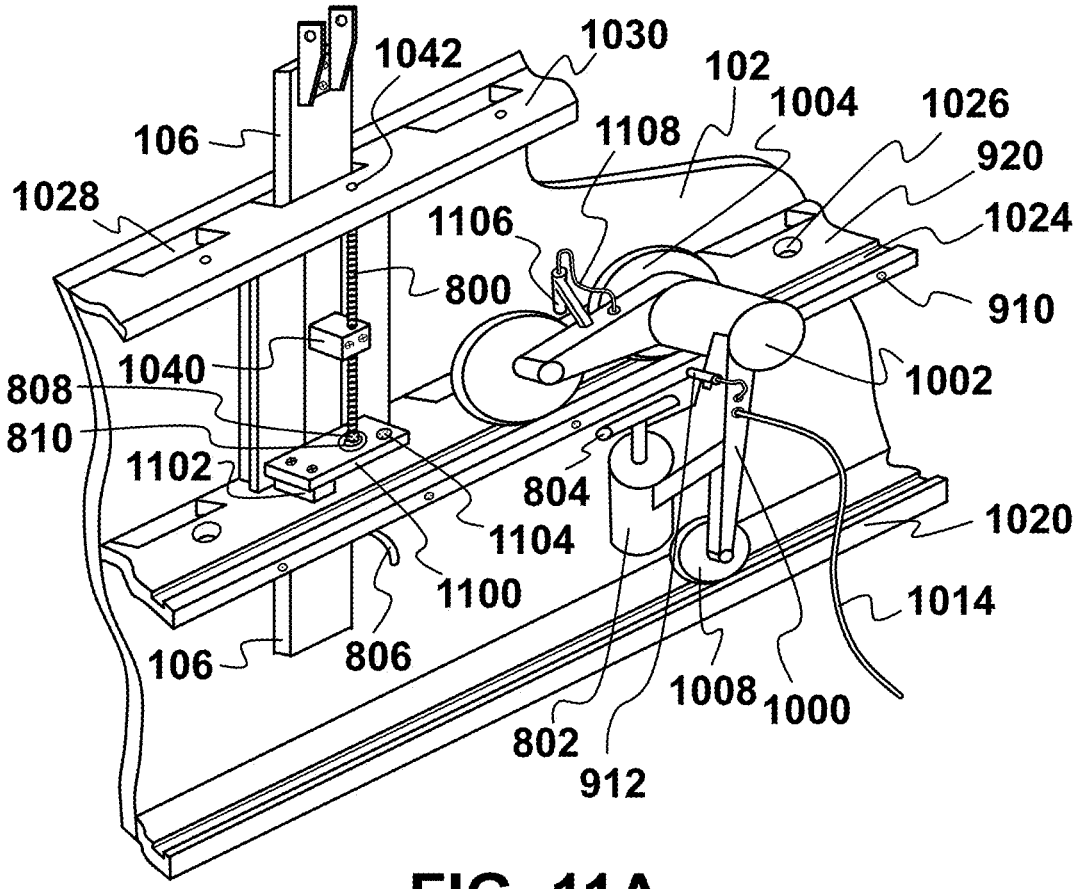

FIG. 11A shows a perspective view of an embodiment of the inside of a bed frame for an electronically controlled slat bed. The embodiment shown in FIG. 11A shows a strut including a jackscrew in which the jackscrew includes a yoke that may be engaged by a T-coupler and motor on a gantry so that the strut may be adjusted. The embodiment of FIG. 11A also shows the jackscrew supported by a flexure that may bend/deflect in response to loading of the strut, and a sensor mounted on the gantry that may sense this bending/deflection of the flexure to estimate the weight loading the strut.

Figure 11B:
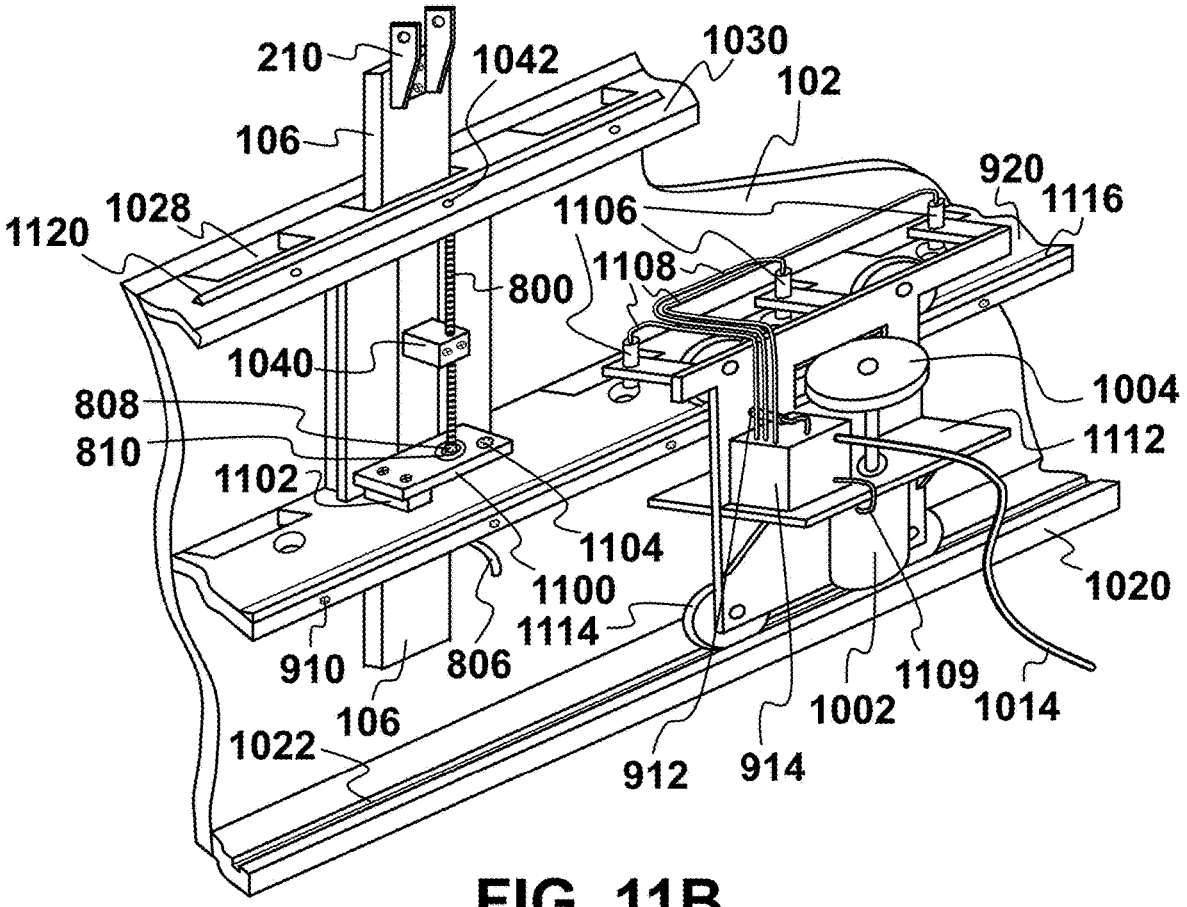

FIG. 11B shows a perspective view of another embodiment of the inside of a bed frame for an electronically controlled slat bed. The embodiment shown in FIG. 11B shows a strut including a jackscrew in which the jackscrew includes a yoke that may be engaged by a T-coupler and motor on a gantry so that the strut may be adjusted. The embodiment of FIG. 11B also shows the jackscrew supported by a flexure that may bend in response to loading of the strut, and three sensors mounted to the gantry that may sense this bending of the flexure to estimate the weight loading the strut. The embodiment of FIG. 11B includes three sensors mounted to the gantry so that the bending of multiple flexures that support multiple jackscrews may be sensed at the same time.

Figure 11C:
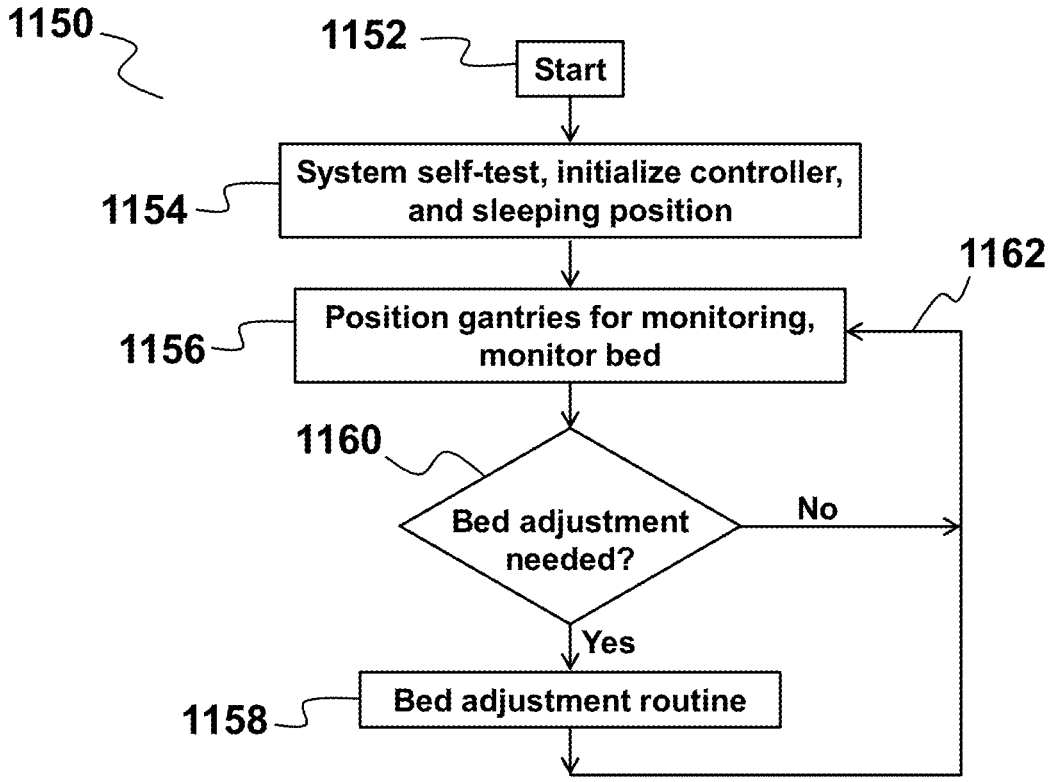

FIG. 11C shows a flow chart of an embodiment of a control routine showing how a bed's gantries may be utilized for monitoring a bed and/or bed occupant when they are not actively adjusting the bed's surface shape.

Figure 12A:
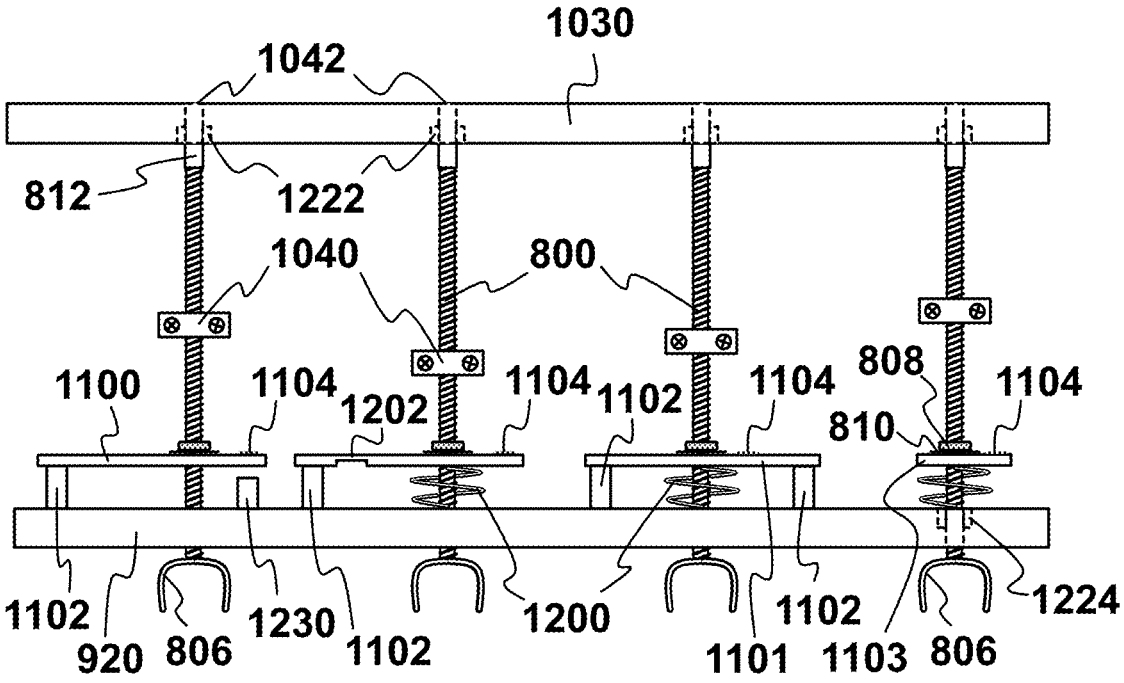

FIG. 12A shows a side view of an embodiment of the inside of a bed frame for an electronically controlled slat bed in which four jackscrews are shown. Each of the jackscrews shown in the embodiment of FIG. 12A are supported using a different technique for a flexible mounting of a jackscrew so that sensing of a flexing action of the jackscrew support may be sensed to provide an indication of the weight load on the strut connected to a given jackscrew. The embodiments shown in FIG. 12A provide examples of how jackscrews may be flexibly mounted and sensed.

Figure 12B:
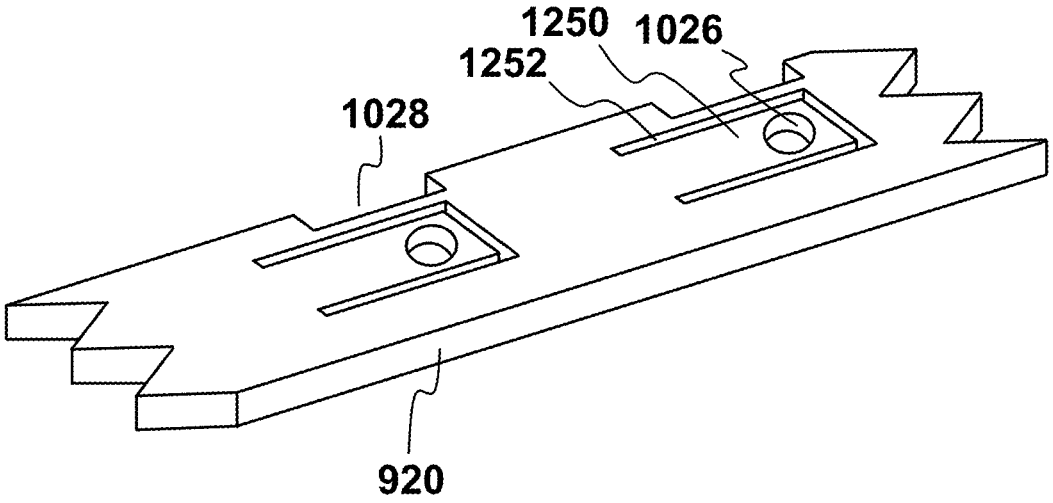

FIG. 12B shows a perspective view of an embodiment of a portion of a bearing support member in which flexures are formed directly in the bearing support member.

Figure 13:
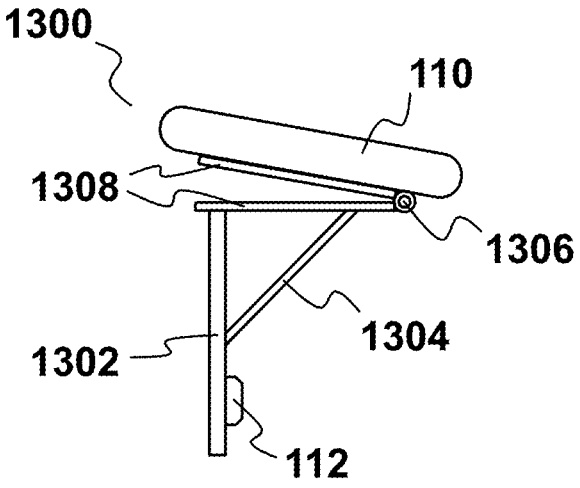

FIG. 13 shows an embodiment of a head platform including a pivoted mounting that allows the head platform to tilt upwards if an upward force is applied to it.

DESCRIPTION

This patent application teaches enhanced systems, techniques, and methods for the application of electronic sensing and control to provide enhanced sleeping comfort and health for beds for humans. Embodiments of electronically controlled slat beds comprising a plurality of slats supported on struts, where the struts may be extended or retracted through control of electric motors, are described. The force or pressure on struts may be monitored and computer algorithms may be applied to optimize the sleeping surface of a bed by determining information about a bed occupant's physical characteristics and sleeping position and adjusting the height of the struts (and so, the slats) to provide a beneficial sleeping surface. Sleeping surfaces may include adjustments of slat heights independently on both ends of a slat so that a sleeping surface that twists along the length of a bed may be provided. Some embodiments of electronically controlled slat beds may comprise struts that are positioned so that, in their plurality, the struts provide a barrier that shield persons, including possibly children, from regions of an electronically controlled slat bed that may cause them injury or other harm. Some embodiments of electronically controlled slat beds may comprise electric motors that may engage jackscrews to extend or retract struts in which the struts are configured to extend, at some positions of their extension or retraction, alongside or below an electric motor actuating the struts so that the struts may be more fully and easily supported in a bed frame. Some embodiments of electronically controlled slat beds may comprise sensors that substantially sense the force on a strut by measuring the deflection of a flexible apparatus, that may be implemented in some embodiments as a spring or flexure, responding to a load applied to the strut. And in some of these such embodiments, the deflection of the flexible apparatus may be measured by sensors applied to a gantry that may be positioned to move relative to a bed frame, and measure a plurality of the flexible apparatuses at various locations in the range of the motion of the gantry. Utilizing a sensor on a gantry in this way may reduce the number of needed sensors in a bed, reducing costs and complexity, and improving consistency of measurements. Techniques for measuring the deflection of a flexible apparatus by a moving gantry may provide electrical isolation between the flexible apparatus and the sensor, benefitting safety. And as a gantry may move along a bed to sense the deflection of a flexible apparatus and control the elevation of struts, it is possible to position a bed's gantries so that forces on selected struts may be measured on substantially a continuous basis (during times when the gantry is not needed to adjust struts). And the struts selected for this level of monitoring may be those anticipated to have varying force applied to them as a bed occupant moves and changes their sleeping position, those that may have varying force on them due to a bed occupant sending signals to a bed, or those that are located relative to a bed occupant so that they allow the bed to monitor the bed occupant's vital signals (heart rate, breathing, etc.) through measurement of those struts. Gantries positioned in this way may monitor bed occupant movements, receive signals from a bed occupant, monitor an occupant's health and vital signs, and adjust the height of one or more struts while they are so positioned. Some embodiments of gantries may allow the weight load on multiple struts to be monitored at the same time. Monitoring the weight load and weight distribution on a bed without making an electrical connection to a slat or strut, as taught in this patent application, may offer benefits in moving electronic sensing physically away from the bed occupant, where measurements are not complicated by close contact to a human bed occupant. A bed occupant's heart rate, breathing, and other health measurements may be made by monitoring the forces applied to struts. Bed occupants may send signals to a bed by bumping or banging their hands, fists, feet, arms, legs, or other body parts against a bed surface; and a bed may respond to such signals by changing some aspects of the bed's surface shape, temperature, or other aspects. Some embodiments may include head platforms and/or foot platforms to support the head and/or feet of a bed occupant. In the interest of safety, some embodiments of head platforms and/or foot platforms may be designed to break away or tilt upward in the event that a body part of a bed occupant is present between a rising slat and the underside of the head or foot platform.

Figure 1A:
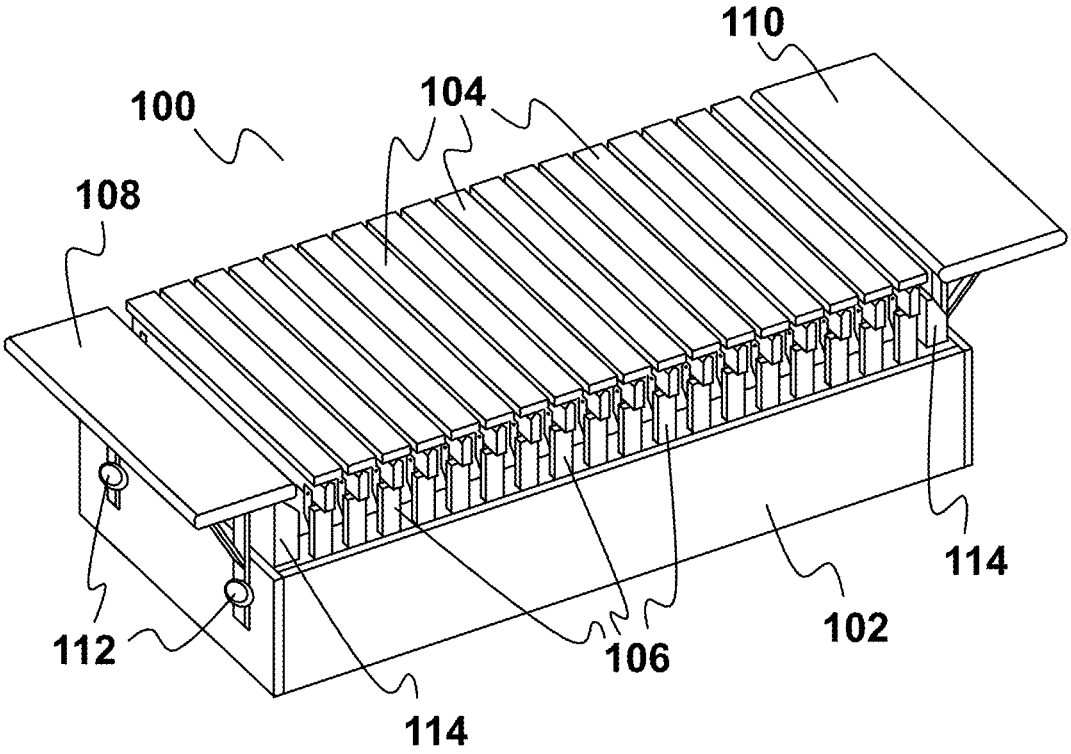
FIG. 1A shows a perspective view of an embodiment of an electronically controlled slat bed. The embodiment shown comprises a manually adjustable head platform and foot platform.

FIG. 1A shows a perspective view of an embodiment of an electronically controlled slat bed 100 comprising a bed frame 102, slats 104, struts 106, a foot platform 108, a head platform 110, adjustment knobs 112, and guards 114. Slats 104 extend over frame 102 and, taken together and along with head platform 110 and foot platform 108, form a base for a sleeping surface. Struts 106 are coupled to bed frame 102 and to slats 104 so that slats 104 may be adjusted in their position through adjustment of struts 106. Head platform 110 and foot platform 108 provide surfaces to support the head and feet, respectively, of a bed occupant. Electronically controlled slat bed 100, as will be explained subsequently, provides a beneficial sleeping position to a bed occupant by sensing forces on slats 104, and by adjusting the extension or retraction of struts 106 from bed frame 102 to create a beneficial shape of a sleeping surface of the electronically controlled slat bed 100 as made up by a plurality of slats 104, head platform 110, and foot platform 108. Some embodiments of electronically controlled slat beds 100 may not include a head platform 110 and/or a foot platform 108 and may comprise additional slats 104 to provide a sleeping surface for a bed occupant of sufficient length for effective sleep. Embodiments of electronically controlled slat beds 100 may include more or fewer slats 104 that are narrower or wider so that the bed is of sufficient length for effective sleep. Embodiments of electronically controlled slat beds 100 in which slats 104 are utilized of varying widths and varying spacing are also possible. The slats 104 in electronically controlled slat bed 100 are made up of a lower supporting member (bottom slat member 200) and an upper member (top slat member 202) that is free to tilt, an embodiment of such a slat 104 will be described with regard to FIG. 2. Head platforms 110 and foot platforms 108 may also be adjusted in height to improve comfort or sleeping position and such adjustment may be undertaken manually by loosening adjustment knobs 112, repositioning the head platform 110 or foot platform 108, and tightening adjustment knobs 112 to secure the platforms in place (details of the adjustment of head platforms 110 and foot platforms 108 are not shown in detail as they use very commonly known techniques). In various embodiments, head platforms 110 and/or foot platforms 108 may also be adjusted in height automatically with electronic controls, by raising or lowering the platforms in response to manual controls delivered by the bed occupant or other operator, or under electronic controls responsive to the position and physical aspects of a bed occupant. An embodiment of electronically controlled slat bed 100 with electrically adjustable head platform 110 and foot platform 108 is shown in FIG. 1E. Guards 114 are shown in FIG. 1A between foot platform 108 and the nearest slat 104 to it; and between head platform 110 and the nearest slat 104 to it. Guards 114 obstruct openings in electronically controlled slat bed 100 to help ensure that hands, fingers, and other body parts, especially of children, may not come into contact with moving and potentially dangerous regions of electronically controlled slat bed 100. Guards 114 may extend across the ends of electronically controlled slat bed 100, spanning substantially the full width of bed frame 102, so that the regions underneath head platform 110 and foot platform 108 are also shielded. That is, a vertical portion of guards 114 may extend the ends of bed frame 102 vertically underneath the bottom sides of head platform 110 and foot platform 108 so that a child or other person cannot access the region of electronically controlled slat bed 100 under the slats 104 by climbing or extending a body limb underneath head platform 110 or foot platform 108.

Bed frame 102 may be fabricated from wood, plastics, metals, other materials, and/or combinations of materials. Some embodiments of bed frame 102 may be constructed so that they may be dis-assembled and re-assembled so that bed 100 may be more easily moved. It is noted that embodiments of beds 100 that include head platforms 110 and/or foot platforms 108 may utilize a somewhat shorter bed frame 102 that may be lighter and easier to move. Embodiments of bed frames 102 may comprise a box formed from sides and ends and may also comprise top and/or bottom elements, these are not numbered in FIG. 1A as the nature and function of bed frame 102 is obvious. Those skilled in the art will recognize that very many possible shapes, construction techniques, configurations, and materials may be utilized to create embodiments of bed frames for various possible embodiments of electronically controlled slat beds. As bed frame 102 houses electronics, motors, and other internal elements of an electronically controlled slat bed 100 (this will be shown and explained in detail later), it may be beneficial for bed frame to include acoustically damping materials, such as foam rubber and other sound deadening materials, to facilitate low noise levels. And, as bed frame 102 houses electrically powered elements such as electronics, sensors, and motors, it may be beneficially constructed to include electrical shielding, grounding, fire retardant materials, and other good design practices to avoid the possibility of fire.

Figure 1B:
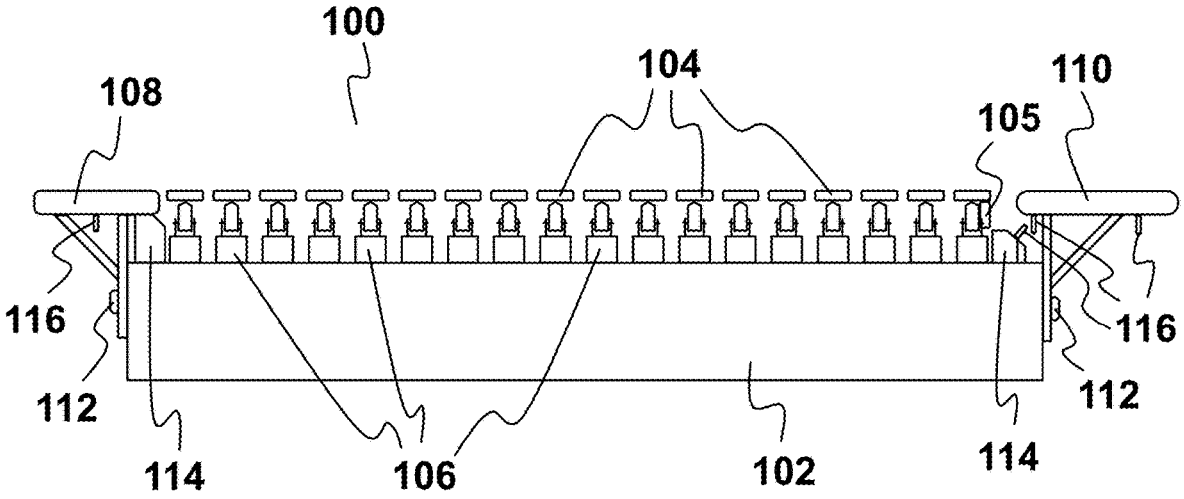
FIG. 1B shows a side view of an embodiment of an electronically controlled slat bed.

FIG. 1B shows a side view of the electronically controlled slat bed 100 shown in FIG. 1A. Like numbered elements in FIG. 1B have the same function as those so numbered in FIG. 1A. Bed covering pins 116 and head slat support 105 shown in FIG. 1B were not visible in FIG. 1A due to the view shown. Bed covering pins 116, as will be subsequently shown, may be affixed to some locations on a bed and utilized to secure one or more layers of bed coverings to electronically controlled slat bed 100. And head slat support 105 may be used in some embodiments to keep the top portion of the slat 104 nearest head platform 110 from pivoting forward due to pressure from bed coverings that will be subsequently described. Head slat support 105 may be implemented simply as a block of wood or other material that blocks the top, tilting portion of a slat 104 from pivoting forward toward head platform 110. In some embodiments, head slat support 105 may be adjustable so that the degree of forward tilting of the tilting portion of the slat 104 may be controlled. And in some further embodiments, head slat support 105 may be replaced with a mechanism controlled by a motor so that the level that the tilting portion of slat 104 is allowed to tilt may be electronically controlled. FIG. 1B shows slats 104 coupled to struts 106, but the scale of electronically controlled slat bed 100 in the figure makes it difficult to fully show the details of the embodiment. Hence, in FIG. 2, the coupling of a slat 104 to a strut 106 is shown and explained in detail. FIG. 1B also makes clear that, for embodiments of electronically controlled slat beds 100 utilizing struts 106 of construction similar to those shown in this patent application, struts 106 may be constructed so that the open space between them is sufficiently small that a person may not significant extend their fingers or other body parts substantially between them. As small children, especially, may be present around a bed in a household, it is important that the construction of the bed be such that a child may not be exposed to potentially dangerous mechanisms. In FIG. 1B, it is clear that struts 106 may be designed to keep the horizontal space between them small, perhaps less than one inch, so that hands, feet, and other body parts may not be substantially extended in between them.

Figure 1C:
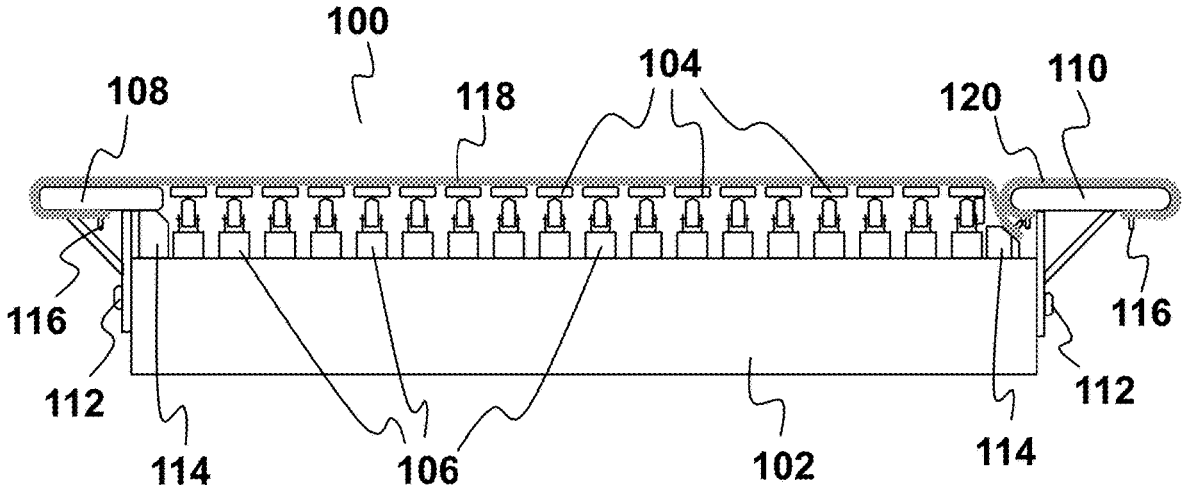
FIG. 1C shows a side view of the embodiment of an electronically controlled slat bed shown in FIG. 1B including bed coverings.

FIG. 1C shows a side view of electronically controlled slat bed 100 including bed covering 118 and head platform covering 120. Like numbered elements in FIG. 1B have the same function as those so numbered in FIGS. 1A and 1B. Embodiments are possible in which a single bed covering 118 extends completely over foot platform 108, slats 104, and head platform 110, but as will be explained with regard to FIG. 1D, there may be benefits to comfort for a bed occupant if a separate head platform covering 120 is used. Bed covering 118 and head platform covering 120 may comprise one or more layers of fabric, canvas, webbing, foam, or other materials; and may provide cushioning, airflow, heat insulation, and other desirable properties for a bed covering. Bed covering 118 is shown extending from bed covering pins 116 under foot platform 108, wrapping over the top of foot platform 108 and over the top of slats 104 and extending to a bed covering pin 116 affixed to guard 114 near head platform 110. Head platform covering 120 wraps over the top of head platform 110 and is affixed to bed covering pins 116 on the underside of head platform 110. Bed covering 118 and head platform covering 120 may simply loop over bed covering pins 116 through holes in the coverings for that purpose. These holes are not shown for simplicity and the fact that hooking a covering over a pin or peg using a hole in a layer of fabric or other material is commonplace. It will be very clear to those skilled in the art that bed covering 118 and/or head platform covering 120 may similarly be secured in place utilizing hooks, Velcro™, snap fasteners, clips, eyelets, grommets, clamps, pockets, elastic, or many other common techniques. And in some embodiments, tension may be applied to bed covering 118 and/or head platform covering 120 with elastic, springs, or other techniques.

A significant benefit of an electronically controlled slat bed 100 is that bed coverings 118 and/or head platform coverings 120 may be sufficiently thin that they may be removed from the bed and laundered. It is noted that conventional mattresses that are commonly used on beds today are normally far too large, heavy, stiff, and thick to be laundered in a household washing machine. However, bed coverings 118 and/or head platform coverings 120 may be, in total, less than 3 inches thick so that they may be conveniently laundered. As noted previously, bed coverings 118 and/or head platform coverings 120 may be made up of multiple layers of materials and these layers may, in some embodiments, be separately applied, so that even if the total thickness of bed coverings 118 and/or head platform coverings 120 is such that they are difficult to launder in combination, they may be separated into individual layers and laundered individually.

Figure 1D:
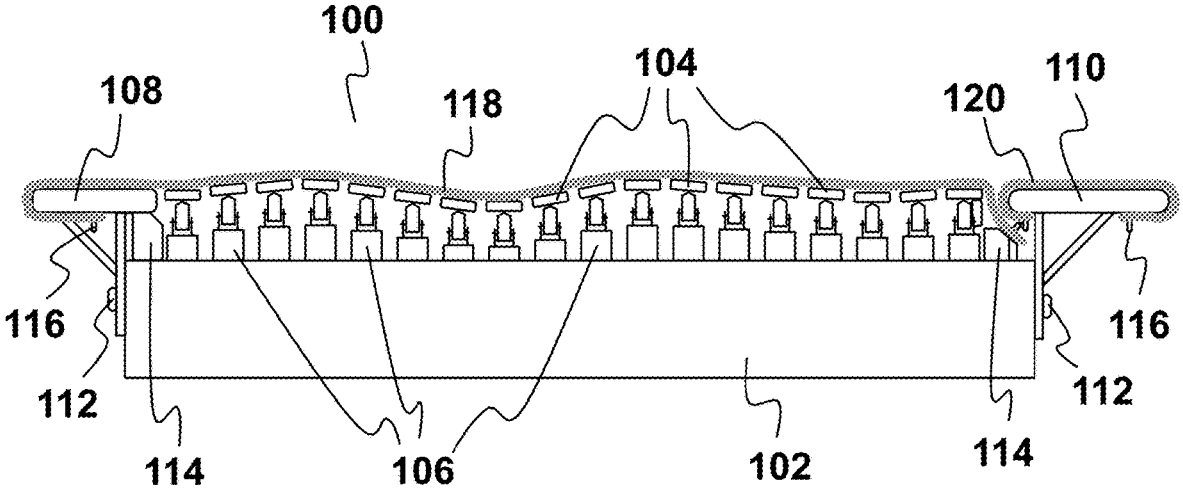
FIG. 1D shows the embodiment of FIG. 1C with the slats adjusted as they might be for a specific person in a specific sleeping position.
Figure 1E:
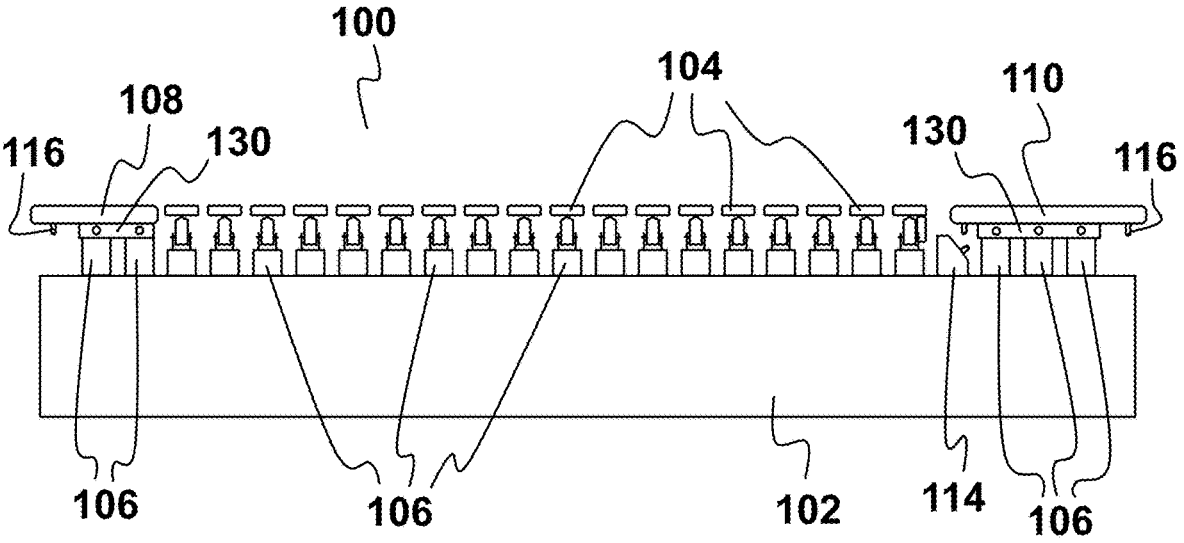
FIG. 1E shows a side view of an embodiment of an electronically controlled slat bed in which a head platform and a foot platform may be automatically adjusted in height and surface angle by controlling the height of struts supporting the head platform and foot platform.

In FIG. 1D a side view of electronically controlled slat bed 100 is shown in which some of the slats 104 have been adjusted in height and the top portion of some of the slats are tilted. Like numbered elements in FIG. 1D have the same function as those so numbered in FIGS. 1A-1C. Clearly, the slats 104 of an electronically controlled slat bed 100 may be adjusted to beneficially conform to the shape of a bed occupant so that the bed occupant is well-supported. Slats 104 together form a base for a sleeping surface and a bed occupant may sleep on top of bed covering 118 that is supported on slats 104 and provides beneficial cushioning to enhance comfort. As will become clear from FIG. 2 and the subsequent figures, it is also possible for an electronically controlled slat bed 100 to adjust one end of some of the slats 104 higher than the other. In this way, a bed occupant lying flat on their back may have one shoulder or hip higher than the other to create a twisted position of their spine. And an electronically controlled slat bed 100 may create movements over time so that a bed occupant's spine and other body joints may be stretched, twisted, and otherwise moved through the course of sleep. The slat 104 positions shown in FIG. 1D may correspond to a beneficial position for someone lying on their back. It is noteworthy that a person sleeping on their side would normally need head support from head platform 110 while needing support under their arm and shoulder from the slats 104 nearest head platform 110 so that a comfortable sleeping position may be provided. These slats 104, for a side sleeping position, would need to normally be significantly below the level of head platform 110; and hence, a side sleeping position may involve the slats 104 nearest head platform 110 being a step height below head platform 110. This is a key reason why bed covering 118 is shown extending over foot platform 108 and slats 104, but not extending over the head platform 110; and why head platform 110 has its own head platform covering 120. Clearly, if a common pillow is used on top of head platform 110, some adjustment of the level of slats 104 near head platform 110 may be beneficial to account for the thickness of the pillow.

It is clear in FIG. 1D that several of the slats 104 are shown with their top member tilted. The top members of the slats of the embodiment of electronically controlled slat bed 100 shown in FIGS. 1A-1D tilt freely and this action will be further described with regard to FIG. 2. It will be clear to those skilled in the art that other types of slats are possible including rigid slats, slats that bend or flex under load, slats that have a compliant top section that may bend under load, and many other types of slats. The benefit of head slat support 105, in some embodiments, to keep the top member of slat 104 nearest head platform 110 from tipping forward (towards head platform 110) is also clear in FIG. 1D. FIG. 1E shows a side view of an embodiment of an electronically controlled slat bed 100 that comprises electrically adjustable head platform 110 and foot platform 108. Like numbered elements in FIG. 1E have the same function as those so numbered in FIGS. 1A-1D. In the embodiment of FIG. 1E, head platform 110 and foot platform 108 are secured to the tops of slats 106 utilizing platform brackets 130 as shown. Many possible constructions of platform brackets 130 that may couple a strut 106 to a head platform 110 or foot platform 108 are possible and will be obvious to those skilled in the art. Hence, no details of the construction of platform brackets 130 are provided here. Platform brackets 130 may attach to struts 106 and platforms with screws, bolts, pivots, adhesive, nails, pins, ball joints, or other fastening techniques; and may allow head platform 110 or foot platform 108 to pivot and tilt as the struts 106 supporting them are adjusted in height. In some embodiments, head platform 110 and/or foot platform 108 may be tilted with respect to either or both a longitudinal (along the length of a person lying on the bed) axis and traverse (orthogonal to the longitudinal axis and in the plane of the top surface of the bed) axis. In the subsequent description and figures, it will become clear how the height of struts 106 may be controlled and how the weight load applied to struts 106 may be sensed; and so, it will be also clear how electrically adjustable head platforms 110 and foot platforms 108 may also be sensed and adjusted through sensing and adjustment of the struts 106 that support them. It is noted in FIG. 1E that four struts 106 support foot platform 108 (the two visible in the figure and two others supporting the far end of foot platform 108 (see FIG. 1A for reference), and similarly, six struts 106 support head platform 110. Clearly, embodiments are possible utilizing different numbers of struts 106 supporting head or foot platforms. It is noted that guard 114 shown in FIG. 1E may be similarly affixed to a strut (this is not shown in FIG. 1E), so that guard 114 may be raised or lowered to better perform its function as a guard and to possibly secure bed coverings 118 as the slats 104 and head platform 110 are adjusted in height. While no guard 114 is shown adjacent to foot platform 108 in FIG. 1E, some embodiments may utilize such a guard (as was shown in previous figures alongside a manually adjustable foot platform). It is noteworthy that as three struts 106 are shown supporting the visible end of head platform 110 in FIG. 1E, that one of the three struts 106 shown (and similarly, one of the three equivalent struts supporting the end of head platform 110 not visible in FIG. 1E) may simply slide freely in and out of bed frame 102 and not actually provide support to head platform 110. Such an embodiment would allow head platform 110 to be adjusted without needing to adjust all the struts 106 attached to it at the same time, but would still provide a complete row of struts 106 alongside the top edge of bed frame 102 to block hands, arms, fingers, and other body parts of persons (especially children) from being extended substantially underneath head platform 110.

Figure 2:
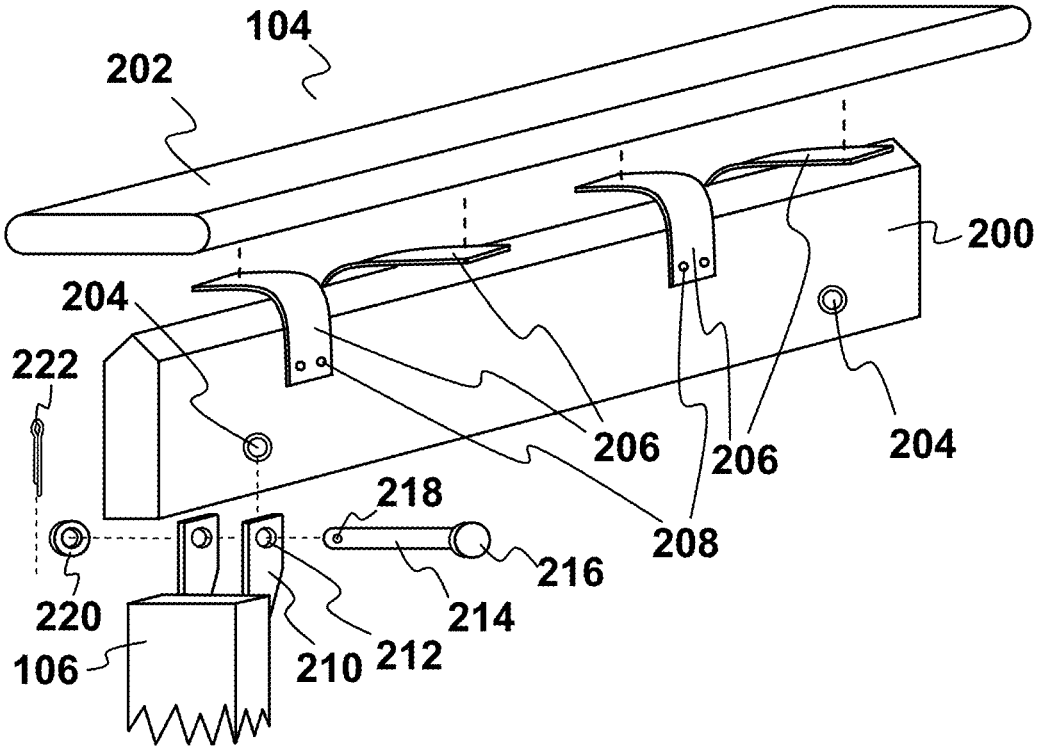
FIG. 2 shows an exploded perspective view of an embodiment of a slat that may be used in an electronically controlled slat bed and shows how a slat and a strut may be coupled.

FIG. 2 shows an exploded perspective view of an embodiment of slat 104, as shown in FIGS. 1A-1E and utilized in electronically controlled slat bed 100. Slat 104 comprises top slat member 202 and bottom slat member 200. Top slat member 202 is shown above bottom slat member 200 and is adjoined to bottom slat member 200 through flexible strips 206. Flexible strips 206 may be made from leather, cloth, plastics, webbing formed from plastics, nylon webbing, and other suitable materials. Flexible strips 206 may be affixed to bottom slat member 200 with nails 208, as shown in FIG. 2, or with adhesives, glue, other fasteners, or combinations of fastening techniques. As show in FIG. 2, the free ends of flexible strips 206 are affixed to the bottom surface of top slat member 202 (as shown by the dashed lines in FIG. 2 extending from flexible strips 206 to top slat member 202), and may be so affixed with nails, adhesives, glue, other fasteners, or combinations of fastening techniques. The top surface of bottom slat member 200 is brought to a point as shown in FIG. 2 so that top slat member 202 may pivot once it is affixed to flexible strips 206. In alternative embodiments, the top surface of bottom slat member 200 may be rounded, faceted, or otherwise shaped to allow top slat member 202 to pivot on top of it. Flexible strips 206 may be extended and affixed to top slat member 202 so that they are in tension and maintain top slat member 202 in position relative to bottom slat member 200 as top slat member 202 is pivoted. The configuration of flexible strips 206 shown in FIG. 2 provides benefit in creating a strong, low-cost way to allow a top slat member to substantially freely pivot above a bottom slat member and conform to a bed occupant. However, other embodiments utilizing fabric, cloth, webbing, or other suitable materials configured in other ways to provide fabric hinges are also possible. Use of mechanical hinges or pivots in which metals, plastics, or other substantially rigid materials are interlocked in the manner of commonly known hinges or pivots to provide pivoting action are also possible. Still other embodiments in which top slat member 202 is positioned atop bottom slat member 200 and is aligned with pins, screws, bolts, or other fasteners in a manner that allows top slat member 202 to pivot are also possible. Those skilled in the art will recognize that many common ways to form a hinge or pivot are possible that may provide a similar pivoting function to that shown in the embodiment of FIG. 2.

In some embodiments of slat 104, top slat member 202 may be perforated or contain holes or be formed from air permeable materials so that air may pass freely through top slat member 202. Top slat member 202 may be fabricated from wood, metals, plastics, laminated materials, or other materials. In some embodiments, top slat member 202 may be fabricated from flexible materials that may bend or flex when pressure is applied to them. And while top slat member 202, as shown in FIG. 2, is of substantially uniform thickness, embodiments are possible in which top slat member 202 varies in thickness over its length and/or width. Bottom slat member 200 may be fabricated from wood, plastics, metals, or other suitable materials. Strut 106 may be fabricated from wood, plastics, metals, or other suitable materials.

Bottom slat member 200 is shown with two slat holes 204 through its sides so that it may be interconnected to strut 106. As shown in FIG. 2 (note the dashed lines in the figure), strut 106 of electronically controlled slat bed 100 is affixed with bracket 210; and slat pin 214 may be inserted through bracket hole 212 of bracket 210, and slat hole 204. Pin head 216 is an enlarged end of slat pin 214 that limits travel of slat pin 214 so that slat pin 214 remains engaged in bracket 210 and can't pass through. On the other side of bracket 210 where slat pin 214 would extend, washer 220 may be placed over slat pin 214 and cotter pin 222 may be inserted through slat pin hole 218 and be bent open so that cotter pin 222 remains in place and keeps slat pin 214 in place so that a pivoting connection between slat 104 and strut 106 is provided (dashed lines in FIG. 2 show how slat pin 214 may be inserted through bracket hole 212 and slat hole 204 and be affixed in place with washer 220 and cotter pin 222). Slat hole 204 may simply be a hole drilled through bottom slat member 200 or may be a lined hole utilizing a bushing material formed from metal, plastic, composite, or other suitable materials. Those skilled in the art will recognize many different ways to connect slat 104 to strut 106 with similar effect, including use of bolts and nuts, bearings, axles, and other types of mountings. In FIG. 2, strut 106 is shown so it may be affixed to one of the two slat holes 204 of bottom slat member 200. In an actual slat bed, the other slat hole 204 shown in FIG. 2 would also be affixed to a strut 106 as is visible in FIG. 9. In some embodiments of slat holes 204, a horizontally slotted or extended hole may be used for one or both of the slat holes 204 in a given slat 104 so that if one end of the slat 104 is raised above or below the other to create a tilted or twisting bed surface, that forces and interference due to a fixed distance between the two slat holes 204, is relieved. In other embodiments, round slat holes 204 may be used and the sides of bed frame 102 and/or struts 106 may bend slightly and provide sufficient compliance so that one end of a slat 104 may be raised above or below the other without encountering high levels of force interfering with such an adjustment of a slat 104.

Bracket 210, slat pin 214, and/or washer 220 may be fabricated from steel, stainless steel, other metals, plastics, or other suitable materials. Cotter pin 222 is a commonly available cotter pin and would normally be made from steel or other metals. In some embodiments, cotter pin 222 may be replace with clips, locking rings, retainers, latches, or other common elements that may serve to secure a slat pin 214 in place. Strut 106 may be fabricated from wood, plastics, metals, other materials, and/or combinations of materials. As will be shown, strut 106 may slide against bed frame 102 and other elements of an electronically controlled slat bed 100, so fabrication of strut 106 from materials that slide easily and offer low friction may be beneficial in some embodiments.

It is a noteworthy benefit that in the embodiment of FIG. 2, if slat pin 214 were to disengage or fall out of bracket 210 that bottom slat member 200 may drop to the top end of slat 106 and be supported there. This embodiment provides a measure of safety, as if it would occur that slat pin 214 falls out of bracket 210, that slat 104 would only fall slightly until bottom slat member 200 contacts the top of strut 106, and no injury would likely occur to a bed occupant.

Figure 3:
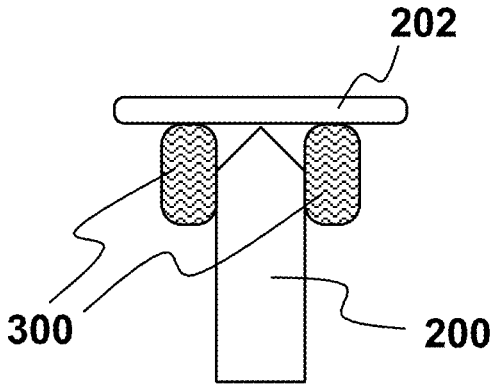
FIG. 3 shows an end view of an embodiment of a slat that includes compliant foam shields to protect persons from pinching their fingers or other body parts between a rocking top section of a slat and a rigid bottom section of the slat.

FIG. 3 shows an end view of an embodiment of a slat for an electronically controlled slat bed 100. The slat of FIG. 3 includes top slat member 202 and bottom slat member 200 shown in FIG. 2, and also comprises foam shields 300 along both sides of bottom slat member 200 and underneath top slat member 202. Foam shields 300 may be formed from foam rubber, plastics, or similar materials and may run the full length of a slat used in a slat bed, or in some embodiments, may only be present near the ends of the slats. Foam shields 300 serves to keep fingers and other body parts out of the region where top slat member 202 may pinch fingers or other body parts if they are inserted between top slat member 202 and bottom slat member 200, and top slat member 202 is tilted. Foam shields 300 are shown directly affixed to top slat member 202 in the embodiment of FIG. 3; in other possible embodiments, foam shields 300 may be positioned somewhat below the bottom surface of top slat member 202 so that they only engage top slat member 202 after it has been allowed to freely tilt by a limited amount. Foam shields 300, in some embodiments, may also serve to buffer the motion and tilting of top slat member 202 so that top slat member 202 may not tilt completely freely and so that tilting action of top slat member 202 requires mildly increasing force for higher amounts of tilting. Buffering the tilting of top slat member 202 in this way may offer benefit in keeping top slat members 202 from rapidly tilting when a bed occupant moves, providing a sense to the bed occupant that the electronically controlled slat bed 100 surface is not shifting rapidly underneath them. Clearly, stiffer materials may be used for foam shields 300 to provide stiffer resistance to tilting of top slat member 202, while more conformant materials would allow top slat member 202 to move more freely. Foam shields 300 may also help to dampen noise that may otherwise occur at times when pivoting motion of top slat member 202 may result in top slat member 202 impacting bottom slat member 200.

Figure 4:
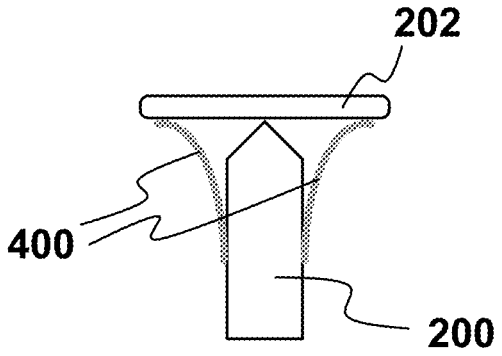
FIG. 4 shows an end view of an embodiment of a slat that includes flexible shields to protect persons from pinching their fingers or other body parts between a rocking top section of a slat and a rigid bottom section of the slat.

FIG. 4 shows an end view of an embodiment of a slat for an electronically controlled slat bed 100. The slat of FIG. 4 includes top slat member 202 and bottom slat member 200 shown in FIG. 2, and also comprises compliant shields 400 along both sides of bottom slat member 200 and underneath top slat member 202. Compliant shields 400 may be formed from plastics, metals, or other suitable materials and may run the full length of a slat used in a slat bed, or in some embodiments, may only be present near the ends of the slats. Compliant shields 400 serves to keep fingers and other body parts out of the region where top slat member 202 may pinch fingers or other body parts if they are inserted between top slat member 202 and bottom slat member 200, and top slat member 202 is tilted.

FIG. 5 shows a side view of an embodiment of a slat for an electronically controlled slat bed 100. The slat of FIG. 5 includes top slat member 202 and bottom slat member 200 shown in FIG. 2, and also comprises stop bumpers 500 positioned between the bottom of top slat member 202 and the top of bottom slat member 200. Stop bumpers 500 may be formed from plastics, rubber, metal springs, or other suitable materials and may be positioned along the length of a slat. Stop bumpers 500 may be applied away from the ends of a slat so that hands and fingers are less likely to reach near them. Stop bumpers 500 may compress between top slat member 202 and bottom slat member 200 to keep top slat member 202 from making a close contact to the top angled surface of bottom slat member 200 so that fingers or other body parts are protected from being pinched. Stop bumpers 500 hold top slat member 202 away from bottom slat member 200 so that some space exists between them when top slat member 202 is fully tilted.

FIG. 6 shows a portion of the side of an embodiment of an electronically controlled slat bed 100. The embodiment of FIG. 6 shows a portion of slat 104 including top slat member 202 and bottom slat member 200, bracket 210, strut 106, bed frame 102, and bed covering 118; and also comprises angled slat end 606, bed covering side flap 600, eyelet 602, plastic cable tie 604, and chamfer 608. In FIGS. 1C and 1D, bed covering 118 was only shown extending over the top surface of slats 104 and not extending over their ends. In FIG. 6, an embodiment of bed covering 118 is shown including an optional bed covering side flap 600 that extends the bed covering 118 over the ends of the slats 104. Bed covering side flap 600 is affixed, as shown in FIG. 6, to one or more of the struts 106 along the side of electronically controlled slat bed 100 with eyelet 602 and plastic cable tie 604. It was noted previously with regard to FIG. 1B that slats 106 as shown embodied in this patent application may be sized so that they form a shield and leave only small spaces between them, so that fingers, hands, and other body parts may be shielded from potentially dangerous areas of electronically controlled slat bed 100. With the addition of a bed covering side flap 600, as shown in FIG. 6, fingers, hands, and other body parts may be further protected as bed covering side flap 600 blocks fingers, hands, and other body parts from contact with bracket 210, the connection between bracket 210 and bottom slat member 200, and the region between top slat member 202 and bottom slat member 200. Angled slat end 606 may be beneficial in some embodiments to avoid the lower corner of bottom slat member 200 from contacting and interfering with bed covering side flap 600. Chamfer 608 applied along the top side corner of bed frame 102 may also contribute to safety as chamfer 608 makes it difficult for fingers, hands, or other body parts to come between some features of strut 106, eyelet 602, or even bottom slat member 200 and be pinched if strut 106 is lowered. Eyelet 602 may be a common "hardware store" eyelet that may be screwed into slat 106 and provide an eyelet opening for plastic cable tie 604 to be applied through eyelet and a hole (that may be a lined hole, hole with a grommet, or otherwise formed hole) in bed covering side flap 600. Those skilled in the art will recognize that many ways to secure a bed covering to a slat are possible and screws, bolts, nuts, pins, snaps, Velcro™, clips, nails, staples, or other techniques may be applied to various embodiments instead of or in addition to use of eyelet 602 and plastic cable tie 604. Plastic cable tie 604 is a commonly available device that is affixed by looping a plastic strip back on itself and through a hole in a feature near one of its ends. Once a plastic cable tie 604 is affixed, it is normally not removable without being cut apart. It is noteworthy that while bed covering 118 is shown as a single uniform layer that extends to form bed covering side flap 600 in FIG. 6, that as previously mentioned, bed covering 118 may be made up of multiple layers of material that may be individually applied or applied together as a single unit of material. In some embodiments of electronically controlled slat bed 100, it may be beneficial to apply bed covering 118 as multiple layers, beginning with a first layer of substantially tough canvas, webbing, thick cloth, or other substantial layer of material. Such a first layer of tough material may extend over the top of slats 104 and also form bed covering side flap 600 so that a first layer of substantially rugged and/or tough material may provide a shield as explained and desired with regard to FIG. 6 so that hands, fingers, or other body parts are shielded from the ends of slats 104 and from possible pinching between slats 104 over the top surface of electronically controlled slat bed. This first substantially rugged and/or tough layer of material may be affixed to slats 104 with eyelets 602 and plastic cable ties 604 or with other permanent or semi-permanent techniques so that the layer of material is difficult or impossible for children to remove. In this way, this first substantially rugged and/or tough layer of material forming bed covering 118 and bed covering side flap 600 may provide an effective safety shield for children or other persons around an electronically controlled slat bed 100. Additional layers forming bed covering 118 and possibly also bed covering side flap 600 that are made from possibly more delicate layers of foam, cloth, or other materials to provide warmth, cushioning, conformance, and other desirable aspects of a bed covering may be applied to electronically controlled slat bed 100 using pockets sewn into those materials, elastic, snaps, clips, Velcro™, and other easily applied and removed methods of securing layers of a bed covering 118 so that these more delicate materials may be easily removed so that they may be easily laundered or replaced. With reference to FIGS. 1A-1E and FIG. 6, those skilled in the art will note that with the combination of proper design of struts 106 to keep spacing between struts 106 small, application of guards 114, and application of a tough bottom layer of bed covering 118 and bed covering side flap 600 well-secured to struts 106, that embodiments of electronically controlled slat bed 100 may be created that are substantially safe with regard to children or other persons contacting regions of a bed where mechanical motion of elements of a bed may otherwise pose a danger. Those skilled in the art will recognize that embodiments not employing bed covering side flap 600 are possible and that, in embodiments including use of bed covering side flaps 600, that many variations in styles and designs of bed covering side flap 600 are possible including use of different materials, different shapes of flap 600, different methods for affixing bed covering side flap 600, incorporation of superficial or decorative materials to bed covering side flap 600, and other possible variations of embodiments.

FIG. 7 shows a graphical view of force measurements 700 taken at each strut 106 in an embodiment of electronically controlled slat bed 100. Force at some or all of the struts 106 of an electronically controlled slat bed 100 may be measured through incorporation of pressure or force sensors in the mechanism of the struts 106, by sensing the torque levels needed in a motor to raise and/or lower a strut, by incorporating force or pressure sensors in slats 104, by incorporating sensors into a gantry that may selectively measure forces or pressure on multiple struts 106, or possibly through other techniques. Sensing pressure or force on the struts 106 of an electronically controlled slat bed 100 allows considerable information about a bed occupant to be deduced and utilized. In the view shown in FIG. 7, force is measured at each strut 106 as represented by strut locations 704. Graphical view of force measurements 700 as shown in FIG. 7 corresponds to a top view looking down on the bed surface of electronically controlled slat bed 100. Strut locations 704 simply indicate in the graphical view of force measurements 700 where each strut 106 is located relative to the graph. Graphical view of force measurements 700 includes bed top outline 702, representative of the full sleeping surface of electronically controlled slat bed 100. Head platform region 710 corresponds to the region of head platform 110 (as shown in FIGS. 1A-1E) and foot platform region 708 corresponds to the region of foot platform 108 (as shown in FIGS. 1A-1E). Some embodiments of electronically controlled slat beds 100 may measure the force on head platforms and/or foot platforms, and in such embodiments, such measurement information may also be used in the optimization of the sleeping surface. Center line 730, shown in FIG. 7, represents the equivalent center of force for each pair of struts 106 connected to the same slat 104 in a slat bed. That is, center line 730 is generated by taking the force measurements represented at each pair of strut locations 704, one along the top of graphical view of force measurements 700 and the other directly vertically below it along the bottom of graphical view of force measurements 700 and computing the location of an equivalent point load on the slat 104 supported by those two struts that would give the same force measurements at those two strut locations 704 (how to perform the mathematics to compute an equivalent point load location for such a situation as that described here is incredibly well-established and will not be repeated here for brevity). This is done eighteen times for the embodiment shown in FIG. 7 of electronically controlled slat bed 100 as the embodiment shown is for a bed with eighteen slats 104. Center line 730 is then drawn using a curve fitting algorithm (such as simple interpolation, spline fitting, or another suitable algorithm) to the set of corresponding equivalent load points. Center line 730 may also be extrapolated over the head platform region 710 and foot platform region 708 to estimate the position of the bed occupant's head and feet. This extrapolation may be done using well-known techniques of graphical analysis (such as spline fitting or other beneficial algorithms). Several circles are shown in FIG. 7 along center line 730. These circles represent estimates of the weight born at the corresponding equivalent load points along center line 730. The total weight born by the two struts 106 connected to each slat 104 is the equivalent load at the equivalent load point associated with that slat 104, and the circles in FIG. 7 simply provide a convenient way to graphically represent those weights. Such circles may be drawn for each pair of struts 106 tied to a given slat 104, or may be lumped together for various regions along center line 730 corresponding to various parts of a bed occupant's body. In FIG. 7, head circle 712 is representative of an estimate of the weight of the bed occupant's head, shoulder circle 714 corresponds to the weight born at the shoulders, chest circle 716 to the weight born at the chest, hip circle 718 to the weight born in the hip region, knee circle 720 to the weight born at the knees, and foot circle 722 to the weight board at the feet. The embodiment shown assumes force measurements are not taken at head platform 110 or foot platform 108, so the forces corresponding to head circle 712 and foot circle 722 in FIG. 7 are based on estimates made based on the size, weight, and distribution of weight of the bed occupant as measured at the struts 106 of electronically controlled slat bed 100 (some embodiments may measure the force load on head platform 110 and/or foot platform 108 directly by applying sensors and, for those embodiments, the associated measurements of force may be used directly as the force represented by head circle 712 and foot circle 722). It is noted that for some bed occupants who may be shorter in height, their feet may not extend to foot platform 108, and, for such bed occupants, the weight of their feet may be measured by the measurement of forces on the slats 104 and struts 106 bearing their feet. The forces corresponding to shoulder circle 714, chest circle 716, hip circle 718, and knee circle 720, may be measured and computed as already explained. Only a few examples of circles corresponding to equivalent point weight load are shown in FIG. 7 and more are possible for various regions of a bed occupant's body (up to a circle for each pair of struts used to compute an equivalent point load for a given slat). And use of circle sizes to represent weight levels is entirely arbitrary and only done for convenience, and to visually represent the weight distribution of a bed occupant. Clearly, representation of weight distribution by other shapes, colors, etc. or simply using actual numerical equivalent point load weight values is also possible in various embodiments.

It is noted that, in some embodiments in which strut locations 704 may be some distance back from the ends of each slat 104, it is possible for the downward force applied to some of the struts 106 to be negative in value. That is, some struts 106 in an electronically controlled slat bed 100 may have an upward force applied to them; in contrast to a downward force as may normally be expected due to a bed occupant resting on a bed. This may occur, for example, if a bed occupant is resting very close to the ends of the slats 104 (i.e. resting along one side of the bed) so that the force on the struts 106 along the side of the bed opposite that at which the bed occupant is resting experience a lifting force on them. It is clearly quite straightforward to accommodate a lifting force on some struts 106 in the sensing, analysis, and computations of graphical view of force measurements 700 and in other aspects of control of an electronically controlled slat bed 100, so embodiments that account for lifting forces on some slats 106 are readily possible. Simple observation of graphical view of force measurements 700, as shown in FIG. 7, makes clear that the bed occupant is lying on their left side (as their knees are protruding toward the bottom of FIG. 7 and the hips are protruding upwards; recall that the view of FIG. 7 corresponds to a top view looking down on the surface of electronically controlled slat bed 100). Hence, it is clear that computer algorithms may use correlation techniques, machine learning algorithms, or other applicable computer algorithms, possibly along with previously stored center line 730 shapes and distributions of weight, to determine whether a bed occupant is sleeping on their front, side, back, or other possible positions. Center line 730 and the quantity and distribution of weight along it, as computed as described above, provides information about the height, weight, and distribution of weight of a bed occupant. And with that information and a determined sleeping position (front, back, side, etc.), struts 106 may be adjusted to control the shape of the surface generated over the top of slats 104, head platform 110, and foot platform 108 to provide a surface shape that provides health and comfort to a bed occupant. Many algorithms are possible that may optimize a surface shape to achieve various goals for maximizing comfort. As an example of an embodiment of a simple algorithm, an electronically controlled slat bed 100 may be based on a look-up table for a range of bed occupants. Persons of various heights and weights may have been studied in side sleeping, back sleeping, and front sleeping positions. And for each of these positions and for each person, electronically controlled slat bed 100 may be manually adjusted to keep their spine, hips, shoulders, neck, head, and feet aligned along as straight a line as possible. If this is done for, for example, one hundred persons representing a broad range of heights and weights, it would be a simple matter, having graphical view of force measurements 700 available for a given bed occupant, to look up the persons in the look-up table having a height within a few inches of the bed occupant's height, and then narrowing that subset of persons in the look-up table to the person having the closest overall weight to that of the bed occupant. Once a person in the look-up table having very close height and weight to a bed occupant is found, graphical view of force measurements 700 may then be correlated to center line shapes and weight distributions for that person in the look-up table in a side, back, or front sleeping position to determine what sleeping position the bed occupant is in; and once that is done, slats 106 may be adjusted to optimize the sleeping position for the bed occupant on the assumption that the optimal bed surface shape (again, in this example, position was optimized for straight alignment of the spine, hips, shoulders, neck, head, and feet) for the bed occupant should be very close to that for the closest person in the look-up table to their height and weight, sleeping in the same sleeping position.

Those skilled in the art will recognize a wide range of computer algorithms that may be applied to optimize the surface of an electronically controlled slat bed 100. An embodiment using correlation techniques to previously stored sleeping positions of a variety of bed occupants was provided as one possible example. Other embodiments may apply machine learning, logistic regression, K-means algorithms, correlation algorithms, other algorithms, or combinations of algorithms. It is also noted that in addition to reaching a beneficial final shape of the top surface of electronically controlled slat bed 100 for a given bed occupant in a given sleeping position, that intermediate shapes as the struts 106 of electronically controlled slat bed 100 are adjusted are also important. As will be shown, embodiments of electronically controlled slat bed 100 may include gantries that can only adjust a limited number of struts 106 at one time, so optimization of which struts 106 are adjusted first and how the shape of the surface of electronically controlled slat bed 100 evolves to provide a desired shape for a given sleeping position is also important. Cost functions that represent a measure of how far a sleeping surface deviates from a desired sleeping surface may be derived and may include weighting factors such as whether a bed occupant is most sensitive to deviations from a desired surface at certain regions of their body (for example, deviations in neck position may be weighted more heavily than deviations in chest position). The value of such a cost function may then be computed through the course of an intended plan for adjusting all the struts 106 of a bed so that an overall discomfort cost (a measure of overall discomfort level for the bed occupant) may be computed. Algorithms may then be applied to compute the discomfort cost of various sequences for adjusting the struts 106 of electronically controlled slat bed 100 and an adjustment sequence minimizing the overall discomfort cost may be chosen. Those skilled in the art will recognize many possible alternatives and algorithms for beneficially optimizing a sleeping surface for a bed occupant.

Additional factors may be taken into account for various embodiments of electronically controlled slat beds 100. Such factors may include the bed occupant's sex, age, health condition, special needs, whether or not a female bed occupant is pregnant, and other relevant aspects. Such information may be provided to an electronically controlled slat bed 100 through an electronic computer interface (many commonly used wired and/or wireless interfaces are possible) from a tablet computer, touch screen display, electronic watch, cell phone, or other commonly known electronic device. And, as stated previously, many algorithms may be generated to optimize the shape of a sleeping surface including force levels, distribution of force, force at specific skeletal locations, skeletal shape, and many other possible factors. It is noted that a bed occupant may also manually control some embodiments of an electronically controlled slat bed 100 to provide a desired surface shape through an electronic computer interface, over-riding the features of such a bed to automatically provide beneficial sleeping surfaces.

The shape of a sleeping surface generated by an electronically controlled slat bed 100 also may not be static. As a bed occupant moves in their bed and shifts their position, electronically controlled slat bed 100, may continue to monitor and optimize its surface shape. Electronically controlled slat bed 100 may also be programmed to rock, tilt back and forth, twist, or otherwise move and alter its surface shape over the course of time to promote beneficial sleep for a bed occupant. Electronically controlled slat bed 100 may also monitor the activity level of a bed occupant and promote motion and movement by a bed occupant to alter their sleeping position over time. For example, some elderly persons have trouble with bed sores from sleeping in the same position for long periods of time. An electronically controlled slat bed 100 may alter its surface shape to shift pressure on the bed occupant to both shift pressure points over time and to possibly encourage a bed occupant to move to a new sleeping position after they have been inactive in a given position for a concerning length of time.

Electronically controlled slat beds 100 may also measure temperature, humidity, heart rate, breathing rate, the onset and level of snoring, and other measures in addition to force and pressure to better assess the sleeping position, comfort level, and health of a bed occupant. Some of these additional measures may be derived from measurements of force on struts over time, or they may be determined from additional sensors. For example, a microphone (or multiple microphones) may be used to measure heart rate, breathing rate, and/or, snoring and a bed's surface may be adjusted accordingly. In this example, raising a bed occupant's head to alleviate snoring may be beneficial. Some embodiments of electronically controlled slat beds 100 may also include heaters, coolers, humidifiers, de-humidifiers, and/or fans that may also be controlled to benefit the comfort and health of a bed occupant based on measurements taken.

It is clear that, in some embodiments of electronically controlled slat beds 100, the absence of a bed occupant may be easily determined through data analysis of graphical view of force measurements 700 (by simply determining there is no substantial weight load on the bed). In such an embodiment, electronically controlled slat bed 100, upon determining that no bed occupant is present, may adjust slats 104, head platform 110, and/or foot platform 108 to predetermined positions. This predetermined adjustment of the sleeping surface may be optimized to be a neat and orderly configuration so that electronically controlled slat bed 100 is substantially attractive and orderly looking when not in use. Alternatively, the predetermined position with no bed occupant present may be a default position that a regular bed occupant prefers to begin their sleep time with, so that the bed is ready and waiting for them in a preferred position the next time they enter the bed.

Some embodiments of electronically controlled slat bed 100 may assume that the weight of blankets or other coverings over the top of a bed occupant are negligible and disregard them in the optimization of a sleeping surface. In other embodiments, the weight of blankets or other coverings over the top of a bed occupant may be estimated from force sensing measurements taken when it is detected that no bed occupant is present so that the actual weights blankets or other coverings over the top of a bed occupant may be taken into account in determining a bed occupant's sleeping position and optimizing a sleeping surface for them. Still other embodiments may apply other techniques to compensate for the weight of blankets or other coverings over the top of a bed occupant.

FIG. 8A shows an embodiment of an electric motor 802 coupled to a jackscrew 800. In various embodiments, electric motor 802 may rotate jackscrews 800 that engage threaded elements (such as transfer block 1040 shown in FIGS. 10-11B and FIG. 12A) or other mechanisms, so that struts 106 coupled to those threaded elements or other mechanisms may be raised or lowered as jackscrew 800 is rotated; such embodiments will be described later. Electric motor 802 has a shaft extending upwards as it is shown in FIG. 8A, and on the motor 802 shaft, a T-coupler 804 is affixed. T-coupler 804 couples yoke 806 that is affixed to jackscrew 800 so that as motor 802 rotates torque is transferred through T-coupler 804 and yoke 806 to jackscrew 800. Jackscrew 800 comprises smooth end 812 that may engage a bearing or bushing supporting the top end of jackscrew 800, retainer 808 may be a sleeve or other element welded or otherwise adhered to jackscrew 800, and bearing 810 that supports jackscrew 800 while allowing jackscrew 800 to turn even if it is bearing a load. Bearing 810 would normally be installed in a supporting platform or structure in an electronically controlled slat bed 100, and retainer 808 would press downwards on bearing so that a load on jackscrew 800 would be supported by bearing 810 and retainer 808.

The embodiment of T-coupler 804 and yoke 806 shown in FIG. 8A provide benefit in allowing a plurality of jackscrews 800, positioned in a row, to be engaged by motor 802 in a simple and effective way. This concept is important for this patent application as struts, positioned in rows as shown in FIGS. 1A-1E, may be then engaged and adjusted in height through rotation of jackscrews 800 coupled to them. If yoke 806 is positioned at a right angle to a row of jackscrews 800 and the top horizontal section of T-coupler 804 is aligned with that same row of jackscrews 800, then motor 802 may be readily moved from one of the jackscrews 800 to the next without interfering with the jackscrews 800. And once motor 802 is directly under one of the jackscrews 800, it may be rotated so that T-coupler 804 may engage and rotate yoke 806. How a motor 802 with a T-coupler 804 may engage multiple jackscrews 800 will be made clear with regard to FIGS. 9-11B. It may be beneficial in some embodiments of slat beds 100 using T-couplers 804 and yokes 806 to stop rotation of jackscrew 800, when a strut 106 height is adjusted, so that yoke 806 is oriented so that motor 802 may move along a row of jackscrews 800 without interfering with yokes 806. In such a system, jackscrew 800 would be rotated to control strut 106 as desired, yoke 806 would then be rotated slightly more or less to leave yoke 806 in a desired orientation as described, and T-coupler 804 would then be rotated away from yoke 806 so that motor 802 may be moved to rotate a different jackscrew 800.

FIG. 8B shows a view of an embodiment of a motor 802 with a first wheel 816 affixed to its shaft, that is coupled to a second wheel 818 affixed to a jackscrew 800. The embodiment of FIG. 8B performs a similar function to that of FIG. 8A, but the T-coupler 804 and yoke 806 are replaced with a first wheel 816 and second wheel 818. Like numbered elements in FIG. 8B have the same function as so-numbered elements in FIG. 8A. Rotation of motor 802 results in rotation of first wheel 816 which couples to second wheel 818 and transfers the rotation to jackscrew 800. Those skilled in the art will recognize that a plurality of jackscrews 800 each affixed to a second wheel 818 could be positioned in a row so they may be individually engaged by a motor 802 and first wheel 816 that is supported by a gantry and moves from one jackscrew 800 to the next. First wheel 816 and second wheel 818 engage and transfer torque by friction between the wheel surfaces. In some such embodiments, it may be beneficial if motor 802 is rotated slowly as motor 802 and first wheel 816 pass by and engage second wheel 818 so that second wheel 818 stays substantially stationary as first wheel 816 engages it and passes by. In such configurations, motion speed of a gantry carrying motor 802 may be coordinated with the rotating speed of motor 802 so that second wheel 818 remains substantially stationary as motor 802 and first wheel 816 pass by engaging and then disengaging second wheel 818. Those skilled in the art will recognize that first wheel 816 and second wheel 818 may have textured, rippled, cogged, or otherwise contoured surfaces to improve their engagement and avoid slippage. Further, first wheel 816 and second wheel 818 may be replaced by gears, in some embodiments, that engage so their gear teeth interlock so that torque between them may be effectively transferred.

FIG. 8C shows the embodiment of FIG. 8B, but with motor 802 and first wheel 816 inverted so that motor 802 is alongside jackscrew 800 as opposed to being below it. Such an embodiment, when implemented with a plurality of jackscrews 800 and a motor 802 mounted to a gantry, may allow for a bed frame 102 that is lower in height and more compact than an embodiment of electronically controlled slat bed 100 constructed with the motor and jackscrew embodiments of FIG. 8A or 8B.

In the embodiment of FIGS. 8A-8C, motor 802 may be a brush-type, brushless, AC induction, stepper, or other type of electric motor and may be electronically controlled. In some embodiments, motors 802 may be selected so that their maximum torque is limited so that they may not seriously injure a bed occupant or other person if a malfunction occurs. Similarly, motor 802 current may be monitored to control and limit torque and possibly also to detect stalls. T-coupler 804 may be made from steel, other metals, plastics, or other suitable materials and may be affixed to the shaft of motor 802 by welding, couplings, splines, pins, bolts, adhesives, or other techniques. Yoke 806 may be made from steel welded to jackscrew 800 or may be made from other metals, plastics, or other materials and may be welded, glued, screwed, or otherwise secured to jackscrew 800. In some embodiments, T-coupler 804 and/or yoke 806 may be formed from compliant or semi-rigid materials such as stiff plastics, or from rigid materials such as steel coated with rubber or plastics to provide a compliant surface; such embodiments may serve to reduce noise generated as T-coupler 804 engages yoke 806. First wheel 816 and second wheel 818 may be fabricated from metals, plastics, rubber, combinations of materials, or other materials and may be fabricated so that they engage smoothly and so that slippage and noise are minimized. First wheel 816 and second wheel 818 may be affixed to motor 802 shaft and jackscrew 800, respectively, with welds, adhesive, pins, bolts, splines, or other techniques. Jackscrew 800 may be formed as a threaded shaft of steel, stainless steel, plastics, or other materials. Retainer 808 may be formed of metals or plastics and may be welded, glued, or otherwise affixed to jackscrew 800. Bearing 810 may be a ball bearing, roller bearing, a bearing formed from plastic or metal bushings, or other suitable bearing capable of bearing the thrust load of jackscrew 800 and facilitating rotation of jackscrew 800. Smooth end 812 of jackscrew 800 may be formed on jackscrew 800 with a lathe or other metal forming machine or may be formed from a metal or plastic sleeve or other covering of the threaded shaft of jackscrew 800.

Those skilled in the art will recognize that use of T-couplers 804 and yokes 806, or first wheels 816 and second wheels 818, in the embodiments of FIGS. 8A-8C are only a few of a very large number of possible embodiments of couplers between motors 802 and jackscrews 800 that may be applied in embodiments of electronically controlled slat beds 100. Embodiments including the use of clutches, wheels, gears, magnetic couplings, magnetic gears, engagement mechanisms, and other possible elements are clearly all possible.

FIG. 9 shows an embodiment of an electronically controlled slat bed with gantry 900. Numbered elements in FIG. 9 perform the same functions as like-numbered elements of previous figures. The view of FIG. 9 shows electronically controlled slat bed with gantry 900 with several slats 104 removed and with bed frame 102 cut away to reveal internal components. The embodiment of electronically controlled slat bed with gantry 900 shown in FIG. 9 does not include a head platform 110 or foot platform 108 to simplify the figure, but it is clearly evident from FIGS. 1A-1E how head platforms 110 and/or foot platforms 108 may be applied in various embodiments. Electronically controlled slat bed with gantry 900 raises and lowers struts 106 through rotation of motors 802 driving T-couplers 804 (as introduced and explained with regard to FIG. 8A and further shown in FIGS. 10-11B). Motors 802 are mounted on gantry 902 and gantry 902 is positioned along the length of bed frame 102 through operation of gantry motor 906 driving gears 908. Gears 908 engage tracks 904 through engagement of teeth in gears 908 engaging slots in tracks 904 so that as gantry motor 906 is rotated, gantry 902 moves along tracks 904 inside bed frame 102. Gantry motor 906 may comprise a stepper motor, brush-type motor, brushless motor, induction motor, or other suitable motor. Gantry 902 may simple slide on tracks 904 or may be further supported by rollers, glides, or other techniques. Position sensor 912 senses when gantry 902 is positioned so that position sensor 912 is directly facing one of a plurality of targets 910 shown affixed to the inside of bed frame 102. Position sensor 912 may operate based on optical, magnetic, ultrasonic, or other physical principles suitable for a position sensor and targets 910 may be reflective, formed of magnetic materials, include features suitable for acoustic or ultrasonic sensing, or be formed otherwise to work in conjunction with suitable embodiments of various position sensors. In one possible embodiment, position sensor 912 may be a magnetic Hall-Effect sensor and targets 910 may be formed from permanent magnets. Those skilled in the art will recognize that information from position sensor 912 may be combined with information from other sensors including possibly a shaft encoder or shaft position sensor on gantry motor 906 to provide additional information on the position of gantry 902 relative to bed frame 102. When position sensor 912 is aligned with a target 910, electronic controller 914 may control gantry motor 906 to halt rotation so that gantry 902 stops in position with motors 802 and T-couplers 804 aligned to yokes 806 (yokes 806 are not visible in the view of FIG. 9, but are attached to jackscrews 800 as shown in FIG. 8A), so that a given pair of struts 106, engaged to jackscrews 800, are coupled to motors 802 and may be raised or lowered under control of electronic controller 914 controlling motors 802. In some embodiments, gantry motor 906 and gantry 902 may have sufficient friction and inertia to hold gantry 902 in place as motors 802 rotate jackscrews 800. In other embodiments, gantry motor 906 may be controlled to provide forces to stabilize gantry 902 as motors 802 are rotated. In still other embodiments, electrically actuated brakes (such brakes are not shown in FIG. 9) may be applied to stabilize gantry 902 as motors 802 are rotated. The embodiment of FIG. 9 shows two motors 802 mounted on gantry 902 to engage two jackscrews 800 to adjust two struts 106 that are coupled to a common slat 104. Those skilled in the art will recognize that some embodiments could include three or more struts 106 coupled to a common slat 104 and, hence, may include a gantry comprising more than two motors 802. Additionally, some embodiments of gantries 902 may be designed to engage and adjust multiple slats 104 at a time. For example, a gantry 902 with four motors 802 may adjust four struts 106 at a time, so that two slats 104 may be adjusted at one time. Electronic controller 914 is electrically coupled to motors 802, gantry motor 906, and position sensor 912 through wires 916 and is powered by power cord 918 shown extending from electronic controller 914 to the inside of bed frame 102. Power cord 918 may be supported with various supports, may extend from a winding reel as gantry 902 moves, or may be supported and positioned using any of a variety of known techniques to manage and position electrical wiring or electrical cords as are found commonly in automated or robotic equipment. In some embodiments, power cord 918 may be replaced with electrical brushes, affixed to gantry 902, that slide over electrified rails inside bed frame 102 and allow power to be provided to gantry 902.

Electronic controller 914 may comprise electronic software and hardware include analog electronics, power electronics, sensing electronics, electronics to power and control motors 802 and gantry motor 906, microprocessors, memory, interface electronics, and other electronic elements. Electronics to power and control motors 802 and gantry motor 906 in electronic controller 914 may comprise electronics to sense motor position and rotational angles, electronics to control and/or sense motor 802 and gantry motor 906 current levels, electronics to sense a stalled motor, electronics to sense temperature and provide safety features to shut down motors if they overheat, and other elements common to the control of electric motors. Software running on a microprocessor or other hardware inside electronic controller 914 may comprise algorithms to generate and process a graphical view of force measurements 700 of an electronically controlled slat bed 100 as was shown and explained with regard to FIG. 7, or other suitable representations of forces present on struts 106 so that a sleeping surface may be optimized to a bed occupant. Electronic controller 914 may also comprise wired or wireless interface electronics that may couple to other or additional gantries, other electronic controllers, keypads, touch screen controllers, or other electronic interfaces. Such wired or wireless electronic interfaces may include USB (Universal Serial Bus), Bluetooth, or other suitable interfaces. And wired or wireless electronic interfaces may also couple electronic controller 914 to cell phones, tablet computers, computers, electronic watches, or other interfaces that a bed occupant may access to provide information to and/or control a bed, and/or receive information or signals from electronic controller 914. Electronic controller 914 may be constructed using a single housing or module as shown in the embodiment of FIG. 9 or may be distributed inside several housings or modules some of which may be mounted to a gantry, and others of which may be mounted elsewhere inside bed frame 102, or possible mounted outside bed frame 102 in a separate housing or module.

Bearing 810 is mounted to bearing support member 920 and bearing support member 920 is mounted to bed frame 102. As was shown in FIG. 8, bearing 810 supports retainer 808, and retainer 808 is affixed to jackscrew 800. As jackscrew 800 rotates, strut 106 is engaged and is raised or lowered. FIG. 8 included yoke 806 to engage T-coupler 804. The embodiment of FIG. 9 also includes yokes 806, but these are not visible in the figure due to the view shown; the yokes in FIG. 9 are below and hidden from view by bearing support member 920. The embodiment of FIG. 10 will make clear how jackscrew 800 couples to and engages strut 106 so that rotational motion of jackscrew 800 is translated to vertical motion of strut 106. Upon review of FIG. 10 and the associated explanation, those skilled in the art will recognize that the embodiment of FIG. 9 may operate on similar, or other commonly used, principles.

With the embodiment of electronically controlled slat bed with gantry 900 a full embodiment of an electronically controlled slat bed 100 has now been explained and its operation should be clear. Motors 802 engage jackscrews 800 and jackscrews 800 are rotated to raise or lower struts 106 to create a beneficial sleeping surface for a bed occupant supported by slats 104. The force or weight on a given slat 106 may be measured by monitoring the electrical current, and hence the torque, needed to rotate a given jackscrew 800 engaged to a given strut 106 (techniques for measuring torque in a motor, including how to compensate for friction, are well-known) so that a graphical view of force measurements 700 (see FIG. 7) may be determined and analyzed, so that a beneficial sleeping surface shape may be determined and provided. It is noted that embodiments of electronically controlled slat bed 100 that don't employ gantry 902 or other embodiments of gantries are possible, and for such an embodiment, an electric motor may be applied individually to each strut 106 to raise or lower it. However, there is considerable cost and weight associated with using an individual motor for each strut 106, so use of gantry 902 or other embodiments of gantries provides considerable benefit.

FIG. 10 shows a perspective view of an embodiment of a single bed-side gantry 1000, coupled to the inside of a bed frame 102. In FIG. 10, only a partial section of a side of a bed frame 102 is shown so that sufficient detail in the figure is visible. Like numbered elements in FIG. 10 perform the same functions as so numbered elements in previous figures. Unlike the embodiment of gantry 902 shown in FIG. 9, that included two motors 802 so that struts 106 on both ends of a given slat 104 could be adjusted at the same time; single bed-side gantry 1000 couples to the inside of a single side of bed frame 102 and only includes a single motor 802 for adjusting struts 106 and a gantry motor 1002 to position the single bed-side gantry 1000. Hence, for the embodiments shown, single bed-side gantry 1000 only adjusts struts 106 along a single side of bed frame 102 and a minimum of two such single bed-side gantries 1000, one coupled to each inner side of bed frame 102, are needed in an embodiment of electronically controlled slat bed 100 so that struts 106 on both ends of slats 104 may be adjusted to form a beneficial sleeping surface. It is noted that some embodiments of single bed-side gantries 1000 may include multiple motors 802 so that multiple jackscrews 800 may be engaged and multiple struts 106 may be monitored or adjusted at the same time. And, in some embodiments of electronically controlled slat beds 100, multiple single bed-side gantries 1000 may be utilized on each side of a bed, so that multiple struts 106 may be monitored or adjusted at the same time.

The embodiment of FIG. 10 includes three supporting members, top support member 1030, bearing support member 920, and lower support member 1020, affixed to the inside of bed frame 102. These three supporting members may contribute to the structure and rigidity of bed frame 102 and may be fabricated from wood, metals, die cast metals, plastics, combinations of materials, or other materials. The function of each of these three supporting members will be subsequently described. While only a portion of these supporting members are shown in FIG. 10, they may extend substantially the full length of the inside of bed frame 102 in various embodiments. Top support member 1030 serves to support the upper edge of bed frame 102 and guides the upper end of struts 106. Bearing support member 920 supports bearings 810 that support the jackscrews 800 that elevate and lower struts 106. And, lower support member 1020 serves to support the lower edge of bed frame 102 and provides a lower guide for single bed-side gantry 1000.

Single bed-side gantry 1000 comprises a structural frame 1001 to which a gantry motor 1002, motor 802, and other elements are mounted. Gantry motor 1002 may comprise a stepper motor, brush-type motor, brushless motor, induction motor, or other suitable motor. Structural frame 1001 may be formed of die cast aluminum, castings of other metals, formed metals, plastics, wood, or other suitable materials. Bearing support member 920 shown in FIG. 10 includes track recession 1024 that is engaged by gantry motor wheel 1004 and gantry top idler wheel 1006. Gantry motor 1002 is affixed to structural frame 1001 of gantry 1000 and provides force to move gantry 1000 to desired positions along bed frame 102. Gantry motor wheel 1004 is driven on the shaft of gantry motor 1002 and engages track recession 1024, along with gantry top idler wheel 1006 to provide smoothly guided motion for gantry 1000 along the inside of bed frame 102. Motor 802 is also affixed to the structural frame 1001 of gantry 1000 and engages a given yoke 806 through T-coupler 804 when gantry is properly positioned to engage a given jackscrew 800 (as sensed by position sensor 912 and sensing targets 910 as were explained with regard to FIG. 9). Yoke 806 is only partially visible in the view of FIG. 10, but has a structure and function the same as that explained with regard to FIG. 8A. The position of single bed-side gantry 1000 along bed frame 102 is sensed by position sensor 912 and sensing targets 910. Position sensor 912 is mounted to structural frame 1001 and is electrically coupled to sensing and control electronics (that may partially or fully provide the functions of electronic controller 914 as explained with reference to FIG. 9) inside structural frame 1001 through position sensor wire 1012. It is noted that the shape and size of the embodiment of targets 910 is different from those shown in FIG. 9, but as the function of them is identical in FIGS. 9 and 10, they are numbered the same. The structural frame 1001 of gantry 1000 also couples to gantry bottom idler wheel 1008 which engages lower track recession 1022 formed in lower support member 1020. Lower track recession 1022 forms a track or rail in lower support member 1020 to guide bottom idler wheel 1008 smoothly along bed frame 102.

In the embodiment of FIG. 10, gantry motor wheel 1004, top idler wheel 1006, and bottom idler wheel 1008 utilize the weight of single bed-side gantry 1000 to maintain engagement with track recession 1024 and lower track recession 1022 so that a smoothly guided motion of single bed-side gantry 1000 is provided. Those skilled in the art will recognize many common techniques that may be applied to various embodiments of gantries 1000 including the use of spring loaded idler wheels, multiple coupled wheels for driving the gantry, use of various shapes and arrangements of tracks/rails/etc. to engage the gantry, use of guides that slide or roll on tracks/rails/etc., gears or cogged wheels to drive the gantry, and other commonly used techniques found in automated or robotic equipment.

Only a single strut 106 is shown in FIG. 10 to avoid cluttering the figure. Strut 106 in FIG. 10 is shown emerging above top support member 1030 through a strut hole 1028 formed in top support member 1030. Multiple strut holes 1028 are shown to make clear where additional struts may be present in a completed electronically controlled slat bed 100. Strut holes 1028 may be designed to fit and smoothly engage with struts 106 so that small fingers of children may not fit between the insides of strut holes 1028 and struts 106. Strut holes 1028, in some embodiments, may be lined with plastic, metal, or other bushings or liners to provide smooth sliding engagement with struts 106.

Bearing support member 920 is shown in FIG. 10 along with bearing 810 supporting jackscrew 800 and retainer 808. Bearing 810 is mounted in a bearing hole 1026 (several bearing holes 1026 are shown in the figure) formed in bearing support member 920. Smooth end 812 of jackscrew 800 is not visible in the view shown in FIG. 10, but is supported inside top bushing hole 1042, which may contain a plastic, metal, or other form of bushing or bearing to smoothly engage smooth end 812 of jackscrew 800. Top bushing hole 1042 is formed in top support member 1030. Transfer block 1040 is coupled to strut 106 and has a threaded hole through which jackscrew 800 passes and engages so that rotational motion of jackscrew 800 is transferred to linear vertical motion of strut 106. Transfer block 1040 may be fabricated from steel, other metals, plastics, or other suitable materials, and may be affixed to strut 106 with screws, bolts, adhesive, couplers, or other common techniques. Strut guides 1029 guide and support strut 106 so that a smooth vertical sliding of strut 106 is possible. Strut guides 1029 may be fabricated from wood, plastics, or other materials and may be lubricated or contain lubricants to facilitate smooth guided motion of strut 106. Multiple strut holes 1028 are shown in bearing support member 920 to allow struts to pass vertically below bearing support member 920. In some embodiments, strut guides 1029 may not be utilized as strut holes 1028 in bearing support member 920 and top support member 1030 may be sufficient to support and guide struts 106. In the embodiment of FIG. 10, strut 106 extends below bearing support member 920. This is beneficial for some embodiments as, while strut 106 is raised, a considerable portion of strut 106 continues to engage strut guides 1029 (and/or strut holes 1028) so that strut 106 is well supported and stable when strut 106 is at or near its maximum vertical extension. Such an embodiment, in which the structure of a strut 106 extends all or most of the height of the side of bed frame 102, may substantially benefit the safety, strength, and stability of an electronically controlled slat bed 100. Additionally, a strut 106, shown in FIG. 10 may be designed so that if some element of the mechanism elevating slats 104 (such as transfer block 1040, jackscrew 800, bearing 810, retainer 808, or other element) were to fail and strut 106 were to abruptly fall, that the end of strut 106 nearest lower support member 1020 would strike and stop upon lower support member 1020, limiting travel of strut 106 and so, reducing the likelihood of injury to a bed occupant.

Embodiments of struts 106, shown in this patent application have a rectangular cross-section. Those skilled in the art will recognize that similar embodiments employing struts utilizing round, oval, square, triangular, trapezoidal, other shaped cross-sections, or combinations of shapes combined together to form novel-shaped cross-sections, are also possible. In some embodiments, hollow struts may be utilized. And in some embodiments of hollow struts, jackscrews may be incorporated fully or partially inside the hollow struts. Struts 106 may also be guided by various guides, rails, ball bearing guides, sliding guides, or other techniques to stabilize and guide them in addition to or in place of the techniques described herein. Struts 106 may be fabricated from wood, metals, plastics, combinations of materials, or other suitable materials.

Struts 106 shown in this patent application are shown coupled to bed frame 102 so that they may slide upwards or downwards as a jackscrew 800 is rotated. However, many other configurations of struts and jackscrews are possible as will be recognized by those skilled in the art. Embodiments of struts coupled with axles, pivots, scissor mechanisms, guides, rails, bearings, or other structures are possible. Hence, for the purpose of this patent application, a strut may be considered to be a physical member coupled to and supporting a slat that is beneficial for the purpose of the teachings of this patent application.

Those skilled in the art will also recognize that alternative mechanisms to elevate struts versus the rotating jackscrew 800 and transfer block 1040 shown in FIG. 10 are possible. For example, instead of rotating jackscrew 800, some embodiments may keep a jackscrew stationary and rotate a hub or coupler around the jackscrew to control the elevation of the hub or coupler, and so, to control the elevation of a strut to which the hub or coupler is coupled. And in other possible embodiments, a threaded jackscrew may be replaced by other members to which gears, pinions, worm gears, cams, clutches, or other mechanisms may engage to allow a motor to adjust a slat.

The embodiment of transfer block 1040 as shown in FIG. 10 is a simple design incorporating a block of material comprising a threaded hole to engage jackscrew 800 that is mounted to strut 106 so that rotational motion of jackscrew 800 results in vertical motion of strut 106. Those skilled in the art will recognize that some embodiments may benefit from designs in which transfer block 1040 includes elements that relax dimensional tolerances between jackscrew 800 and strut 106, that relax the effect of heavy loads on strut 106 causing transfer block 1040 to pivot under stress and possible bind against jackscrew 800, or that provide other benefits. Embodiments in which transfer block 1040 is constructed from elements that slide together and engage so that changes in the distance between jackscrew 800 and strut 106 may be accommodated, elements that incorporate pivots so that the outer body of transfer block may pivot relative to jackscrew 800 without causing binding, or other possible designs that relax dimensional or alignment requirements are clearly possible.

The vertical range of motion of strut 106 may be limited by the possible range of travel of transfer block 1040, by the bottom end of strut 106 striking lower support member 1020, by additional stops or limiters that may be applied in some embodiments, or through electronic sensing and control of strut 106 as may be used in some embodiments. For any such embodiment, it is important to establish a baseline height for the struts 106 (and hence the slats 104) of an electronically controlled slat bed 100 so that the struts 106 may then be adjusted relative to each other and possibly to a head platform 110 and/or foot platform 108, so that a beneficial bed surface may be provided. This may be done by adjusting all struts 106, to their limit (possibly sensed by when a motor 802 driving the strut 106 stalls), so that they are then in a known and consistent position from which they may be adjusted. For example, if the lower range of motion of strut 106 is limited by when it strikes lower support member 1020, all struts 106 in an electronically controlled slat bed 100 may be adjusted downward until all of them are at their lowest position striking lower support member 1020. Electronic controller 914 (electronic controller 914 is not explicitly shown in FIG. 10, but it may be housed inside structural frame 1001, and a bed based on the embodiments of FIG. 10 would include a controller function) may then keep track of the height of each strut 106 as it is adjusted, by counting the turns of motor 802 used to adjust each given strut 106. Clearly, these motor 802 turn counts must be maintained and updated each time any strut 106 is adjusted. And if the count is ever lost (due to a momentary power failure or other cause), the electronically controlled slat bed 100 would need to re-establish the baseline position of all struts 106 (as just explained). As the baseline position of struts 106 in this example is in reference to bed frame 102, heights of a head platform 110 or foot platform 108 may also be applied (whether they are done manually or automatically) with respect to bed frame 102 as well for good results. Finally, those skilled in the art will also recognize that embodiments are possible in which the height of each strut 106 may be sensed using position or distance sensors (such common sensors may operate on light, acoustic waves, magnetics, radar, or other principles) so that their heights are known and the need to baseline their position is not required (but regrettably, the additional sensors add cost and complexity to a bed design).

Single bed-side gantry 1000 may be powered and/or controlled through gantry electrical cable 1014. Gantry electrical cable 1014 may connect gantry 1000 to an electronic controller 914 housed inside or near to bed frame 102 or the functions of electronic controller 914 may be included in electronics housed inside or mounted to the structural frame 1001 of gantry 1000. As a full embodiment of an electronically controlled slat bed 100 based on the embodiment of single bed-side gantry 1000 shown in FIG. 10 would normally include at least two gantries 1000, each coupled to one side of bed frame 102, some embodiments may benefit from communications between the two or more single bed-side gantries 1000. This may be facilitated by a wired or wireless connection, possibly over electrical cable 1014, between the gantries 1000. Communications between multiple gantries 1000 may allow the gantries to coordinate their functions to benefit the comfort of a bed occupant. Multiple gantries 1000 may coordinate their functions in a master-slave arrangement, where one gantry provides direction to and controls the others; in a token key arrangement, in which the gantries pass an electronic token to designate a master; or in other well-known configurations for coordinating activity between automated or robotic functions.

The embodiment of bed frame 102 including gantry 1000 in FIG. 10 may provide benefit for some embodiments of electronically controlled slat beds 100 as gantry 1000 is directly coupled to the side of bed frame 102. This may allow a more resilient and less rigid construction of bed frame 102 than would otherwise be possible as gantry 1000 can move with bed frame 102 as bed frame 102 responds to applied forces. The ability to use thinner and lighter sides to bed frame 102 may make moving and transporting them easier. As previously explained, an embodiment of electronically controlled slat bed 100 based on gantry 1000 as shown in FIG. 10 would involve at least two such gantries 1000, one coupled to each side of bed frame 102 so that each end of a given slat 104 may be sensed and controlled. Gantry 1000 as shown embodied in FIG. 10 is also designed to easily assemble with bed frame 102 as the gantry wheels and idlers need only be placed into the track recessions. And as gantry 1000 only needs to align with a single yoke at a time, there is no need for gears or slotted tracks to keep the gantry aligned from one side of bed frame 102 to the other (as were used in the embodiment of FIG. 9). Indeed, two gantries 1000 could operate independently inside a bed and even adjust various struts 106 coupled to a common slat 104 at different times from each other. The wheels and idler wheels of gantry 1000 may be made from rubber, plastics, or other materials to provide smooth and quiet operation. Also, as gantries 1000 are easily installed, it is possible to place multiple gantries 1000 along a single side of a bed frame 102 so that multiple struts 106 may be adjusted at the same time, allowing the struts 106 of a bed to be adjusted more quickly.

FIG. 11A shows a perspective view of an embodiment of a single bed-side gantry 1000 coupled to the inside of a bed frame and including a flexure 1100 supporting strut 106. In FIG. 11A, only a partial section of bed frame 102 is shown so that sufficient detail in the figure is visible. The view of FIG. 11A is mostly similar to FIG. 10 and like numbered elements in these figures have the same function. In the view of FIG. 11A, jackscrew 800 has been rotated to elevate strut 106 and transfer block 1040 so that a clear view may be provided of flexure 1100, flexure support 1102, and flexure target 1104. Bearing 810 is mounted in flexure 1100 and supports jackscrew 800 and retainer 808. Bearings 810 may be mounted in bearing holes 1026 formed in flexures 1100. Bearing holes 1026 formed in bearing support member 920 may not actually support bearings in embodiments where flexures 1100 are used, but may still be present to allow jackscrews 800 to pass through bearing support member 920. Gantry 1000, as shown in FIG. 11A, includes flexure sensor 1106 and flexure sensor wire 1108. As was described previously, the force bearing down on a strut 106 may be measured by monitoring the current needed in motor 802 to rotate jackscrew 800 and deriving the associated motor 802 torque based on the motor torque constant (using very well-known analysis). However, measuring the force on a strut 106 using motor current is time-consuming as each jackscrew 800 in a bed must be rotated and the analysis performed. Also, while the effect of friction in jackscrew 800 may be accounted for (at least partially), this generally requires jackscrew 800 to be rotated in both directions, further consuming time. Hence, some embodiments of electronically controlled slat beds 100 may benefit from more rapid methods of measuring the force on a strut 106. Krenik '666 teaches use of electronic sensors to directly measure force on a strut 106 through sensing directly on a jackscrew 800 coupled to a strut 106, or by adding members to a slat 104 so that sensors may be placed between an upper and lower portion of a slat. However, connecting sensors positioned as shown in Krenik '666 requires that wiring for the sensors be distributed through the structure of a bed. In contrast, the technique of FIG. 11A allows the force on a strut 106 to be quickly measured without the need to rotate motor 802 and may involve no wiring outside of wiring on single bed-side gantry 1000. Flexure 1100 is mounted (using screws, bolts, adhesive, or other mounting techniques) to bearing support member 920 with flexure support 1102 spacing one end of flexure 1100 above bearing support member 920, so that, as force on strut 106 couples to jackscrew 800 via transfer block 1040, flexure 1100 bends/deflects in response and the degree of deflection of flexure 1100 is indicative of the force applied to strut 106. While the embodiment of FIG. 11A utilizes flexure 1100 to provide an element that deflects in response to weight load applied to a jackscrew 800, other forms of flexible apparatuses may be used in place of flexure 1100 in some embodiments. Later, it will be explained that such flexible apparatuses may include elements that not only bend or deflect in response to applied weight loads, but may respond to applied weight loads by varying other characteristics that may be measured by a sensor. It is noted that, for the embodiment of FIG. 11A, smooth end 812 (not visible in FIG. 11A) of jackscrew 800 will both rotate and move up and down inside top bushing hole 1042. Flexure 1100 may be made of spring steel, other alloys of steel, stainless steel, other metals, plastics, wood, laminations of materials, or other materials that provide the function of flexing in a substantially repeatable and consistent way to applied force. The thickness, width, length, shape, mounting, materials, and other design elements utilized for flexure 1100 may be chosen to substantially provide a pre-determined level of deflection of flexure 1100 in response to a desired range of measureable weight loads on a jackscrew 800 and strut 106 coupled to flexure 1100. Some embodiments may utilize the same design of flexure 1100 for all struts 106 in a bed, while others may apply more sensitive flexures that may sense lighter weight loads in some portions of a bed while using more rigid flexures in regions of a bed more commonly supporting higher weight loads. The amount that flexure 1100 bends in response to force applied to strut 106 may be measured by measuring the distance from flexure target 1104, affixed to flexure 1100, to flexure sensor 1106 when gantry 1000 is positioned so that flexure sensor 1106 is substantially above flexure target 1104. Flexure sensor 1106 may measure distance using ultrasonic, acoustic, light, electromagnetic, magnetic, or other possible sensing techniques as are commonly used to measure distance. And flexure target 1104 may be made from reflective materials (for light sensing), magnetic or conductive materials (for magnetic distance sensing), or other suitable materials to facilitate a reliable measurement of the deflection of flexure 1100 in response to weight load on strut 106. Some embodiments may utilize a mechanical contact between flexure 1100 and flexure sensor 1106. For example, a roller mounted on a lever arm extending from single bed-side gantry 1000 may roll over flexure target 1104 and mechanically couple to an LVDT (Linearly Variable Differential Transformer) or other electro-mechanical motion sensor to measure the deflection of flexure 1100. In some embodiments, a flexure target 1104 may not be needed as a sufficiently accurate measurement may be obtained in some embodiments by directly measuring to the surface of flexure 1100. Flexure sensor 1106 is shown in FIG. 11A configured to sense the top surface of flexure target 1104 affixed to the top surface of flexure 1100; however, embodiments in which a sensor is used to sense the deflection of a flexure from the bottom surface, side surfaces, at an angled alignment, or in other possible configurations are also possible. As previously noted, struts 106 in a bed may experience either a downward or an upward force depending on the configuration of the bed and the location of a bed occupant on the bed surface. Hence, flexure 1100 may deflect either upwards or downwards and flexure sensor 1106 may be configured to measure both upwards and downwards deflections in some embodiments. Flexure sensor 1106 may couple electrically to electronics (possibly including the function of electronic controller 914 as previously described) contained inside gantry 1000 through flexure sensor wire 1108. As electronics for conditioning and measuring sensors are very well-known in present art, no additional description of how flexure sensor 1106 is electronically interfaced is provided here.

In addition to providing a flexible member for the measurement of force on strut 106, flexure 1100 may also provide benefit to a bed by providing some degree of compliance and spring function to strut 106. Hence, flexure 1100 may, in some embodiments, be designed to provide a substantial range of motion (perhaps an inch or more) to provide both spring functions to strut 106 and/or to provide a technique for measurement of force on strut 106. In other embodiments, flexure 1100 may move only sufficiently for taking force measurements (this may involve movement of only a fraction of an inch).

In some embodiments, force on struts 106 may be measured using both measurements of motor 802 current and torque and measurements of the deflection of a flexure 1100. This may allow a double check on the force applied to struts 106, allow one method of force measurement to be used to correct or calibrate the other, allow an indication of high levels of friction in the rotation of jackscrew 800 signaling the need for lubrication or other maintenance, or to provide other system benefits. It is noted that if high levels of flexure deflection or motor torque are detected, as may occasionally occur as a bed occupant moves and applies large portions of their weight to a single strut, it may be beneficial to avoid further rotation of the jackscrew associated with that strut, to reduce wear and avoid wasting energy, until the distribution of weight is changed. In at least some such situations, the heavy weight load condition may be relaxed as the bed occupant completes their motion, and normal operation can then be resumed.

In addition to bending/flexing of flexure 1100, bearing support member 920 may also bend/flex under load. Hence, some embodiments of electronically controlled slat beds 100 may include two or more flexure sensors 1106 on each single bed-side gantry 1000 so that the differential distance between flexure target 1104 and the top surface of bearing support member 920 may be directly measured. In other embodiments, flexure sensor 1106 may measure the distance to the surface of bearing support member 920 (possibly nearby flexure target 1104) as gantry 1000 is moved so that both a measurement to flexure target 1104 and to bearing support member 920 are available and the difference may be used as an indication of the actual level of bending of flexure 1100. Some embodiments may have additional flexure targets 1104 mounted at various heights above bearing support member 920 for calibration purposes. For example, rigidly mounted flexure targets 1104 mounted to bearing support member 920, that represent the maximum and minimum heights at which a flexure target 1104 mounted to a flexure 1100 would be found, may be useful to calibrate the full scale range of the measurements of flexure targets 1104. Other embodiments may reference measurements of the height of flexure target 1104 relative to top support member 1030 or other elements of bed frame 102. Those skilled in the art will recognize many common techniques for sensing and calibrating weight scales (and other common devices), that may be applied to the sensing and calibration of the deflection of springs or flexures in an electronically controlled slat bed 100.

Flexure target 1104 may be positioned relative to bearing support member 920 so that flexure sensor 1106 is properly positioned to measure the distance to flexure target 1104 when position sensor 912 indicates that gantry 1000 is positioned to rotate the jackscrew 800 to which the given flexure target 1104 is associated. In other embodiments, measurement of flexure target 1104 and rotation of jackscrew 800 by motor 802 may be undertaken at different locations along the range of travel of gantry 1000. In some embodiments, flexure sensor 1106 may be designed so that gantry 1000 may move continuously while the distances to a plurality of flexure targets 1104 are measured in turn as the gantry 1000 passes by. Such an embodiment may be desirable as it allows the force on a number of struts 106 to be measured quickly. When gantry 1000 is moving, flexure sensor 1106 may be used to take multiple readings of the distance to each flexure target 1104 as gantry 1000 passes by. Combination of these readings of the distance to each flexure target 1104 and computer analysis may allow a minimum distance between flexure target 1104 and flexure sensor 1106 to be determined so that errors due to misalignment of gantry 1000 position as measured by position sensor 912 and targets 910 (operation of which has been previously explained) and optimal alignment of flexure sensor 1106 and flexure targets 1104 may be calibrated out of determined weight load readings for a given strut 106. In some embodiments, readings of distances between flexure sensor 1106 and flexure targets 1104 may be configured so that they are at a minimum level as gantry 1000 is moved so that the position of gantry 1000 relative to jackscrews 800 is determined by flexure sensor 1106 and flexure targets 1104, and so, position sensor 912 and targets 910 may not be present or utilized in such embodiments.

In some embodiments, flexure sensor 1106 may be configured to directly measure the distance to the top surface of flexure 1100 (and no flexure target 1104 would be utilized, or alternatively a continuous flexure target 1104 along substantially the full length of flexure 1100 may be utilized). For some such embodiments, the distance from flexure sensor 1106 to the top surface of flexure 1100 may be substantially continuously recorded as gantry 1000 moves along its range of travel so that a substantially continuous waveform of the distance to the top surfaces of the flexures 1100 utilized in an electronically controlled slat bed 100 may be generated. For such embodiments, the waveform of the distance to the top surfaces of the flexures 1100 may be then utilized to more optimally determine the weight load on each flexure 1100 as the actual shape of each flexure 1100 under load may be analyzed to determine the weight load bearing on it (and not just a single point distance reading from a flexure target to a flexure sensor).

As a flexure 1100 bends/deflects in response to weight load on a strut 106 coupled to it, some variation in the measured distance between flexure sensor 1106 and flexure target 1104 may occur as flexure target 1104 tips to an angled position in response to the bending and deflecting of flexure 1100. Multiple measurements of the distance between flexure sensor 1106 and flexure target 1104 as gantry 1000 is in motion may be utilized in some embodiments to calibrate out the effect of an angled/deflected flexure target.

Those skilled in the art will recognize that common signal processing techniques such as averaging, removing outlier or errant measurements, filtering, smoothing, correlating, and other well-known techniques to reduce errors, calibrate, correct, or otherwise enhance the usefulness of sensor readings may be applied to various embodiments of flexure sensors 1106 and flexure targets 1104. It is also noted, that like all systems involved springs or flexures, springs and flexures may change somewhat in shape as they age and as load has been applied to them for extended periods of time. Hence, electronically controlled slat beds 100 may benefit from taking readings of flexure 1100 deflection when no bed occupant is present so that the effect of aging may be calibrated out of the computation of weight load on struts based on flexure 1100 deflection. Such calibration measurements may be taken automatically when no bed occupant is sensed to be present, or may be initiated manually be an operator controlling a bed. Those skilled in the art will recognize many common techniques utilized in the maintenance and calibration of weight scales and other measurement systems that may be readily applied to various embodiments.

FIG. 11B shows a perspective view of another embodiment of the inside of a bed frame 102 for an electronically controlled slat bed 100 including a single bed-side gantry 1112 comprising three flexure sensors 1106. Numbered elements in FIG. 11B have the same function as so-numbered elements in previous figures. The embodiment of single bed-side gantry 1112 in FIG. 11B comprises two guide wheels 1114 that engage lower track recession 1022 and two guide wheels 1114 that engage upper guide ramp 1116. Action of guide wheels 1114 on upper guide ramp 1116 serves to force single bed-side gantry 1112, through action of the weight of single bed-side gantry 1112 on the sloped surface of upper guide ramp 1116, toward bearing support member 920 so that gantry drive wheel 1004 engages against the edge of bearing support member 920 and achieves traction. Action of gantry motor 1002 on gantry drive wheel 1004, mounted to the shaft of gantry motor 1002, then drives single bed-side gantry 1112 along the inner side of bed frame 102 so that multiple jackscrews 800 and struts 106 may be engaged, sensed, monitored, and/or adjusted. Lower track recession 1022 guides the lower portion of single bed-side gantry 1112 to keep single bed-side gantry 1112 properly oriented. As single bed-side gantry 1112 moves along the inside of bed frame 102, position sensor 912 detects targets 910 so that electronic controller 914 may control gantry motor 1002, via gantry motor control wire 1109, to stop at positions so that a motor 802 mounted to single bed-side gantry 1112 may engage yoke 806 with a T-coupler 804 affixed to motor 802 as was shown and explained in FIG. 8A. Yoke 806 is partially visible in FIG. 11B, while motor 802 and T-coupler 804 are not visible due to the view shown as they are located on the side of the frame of single bed-side gantry 1112 not visible (the purpose and use of motor 802 and T-coupler 804 are very well-established in prior figures and description, so lack of them being visible in FIG. 11B leaves no doubt of their location and function). The embodiment of FIG. 11B includes three flexure sensors 1106 mounted to the frame of single bed-side gantry 1112 so that the deflection and, hence, the weight load on three adjacent struts 106 may be measured while motor 802 is adjusting the height of strut 106 corresponding to the middle flexure sensor 1106 mounted to single bed-side gantry 1112. In some embodiments, the ability to measure the weight load on a strut 106 that is being adjusted in height, while also measuring the weight load on the adjacent struts 106 on either side of the strut 106 being adjusted, may be beneficial. For example, a possible safety concern for an electronically controlled slat bed 100 is a condition in which snagged bed coverings may become tight over a bed occupants body, and possibly their neck, as a slat 104 is raised. The weight load on a strut 106 may be measured as it is adjusted upwards, but as weight is normally transferred from adjacent struts as a given strut is raised, it may be difficult to distinguish if the additional weight is only due to normal transfer of weight or if it could be due to a safety concern such as a snagged blanket tightening over a bed occupant. Consequently, by measuring the weight load of adjacent struts 106 as a given strut 106 is adjusted, the sum of the weight load on three struts may be monitored together so that the additional force due to a tightening blanket or other unexpected load that may signal a safety concern may be better detected by electronic controller 914 (electronic controller 914 is shown mounted to the frame of single bed-side gantry 1112 in FIG. 11B). Those skilled in the art will recognize that embodiments with one, two, three, or larger numbers of flexure sensors 1106 on a gantry are possible. Additionally, while the structure of single bed-side gantry 1112 in FIG. 11B is somewhat different from the structure of single bed-side gantry 1000 in FIB. 11A, those skilled in the art will recognize that single or multiple flexure sensors 1106 may be applied to either of these, or other possible embodiments of gantries for electronically controlled slat beds 100. Those skilled in the art will recognize that the techniques described with regard to FIGS. 11A and 11B and the application of flexures to measure weight loads may be applied to other configurations of gantries from the embodiment shown in FIGS. 11A and 11B. Clearly, the embodiment of gantry 902 shown in FIG. 9 may be adapted to allow a system of flexures, springs, etc. to also be used to measure weight loads on struts. And other embodiments, using other numbers and configurations of gantries may also take benefit of measuring forces by measuring the deflection of a flexure or spring element.

FIG. 11B also includes safety switch 1120 mounted on top support member 1030. Safety switch 1120 may be included in some embodiments to allow electronically controlled slat bed 100 to detect if a foreign object has been inserted between struts 106. Such a foreign object may be hand, foot, or other body part and the presence of such an object may signal a safety concern. Safety switch 1120 may be a continuous or semi-continuous contact switch or pressure sensor that allows electronically controlled slat bed 100 to monitor it and, hence, monitor for the presence of an object contacting and pressing down on safety switch 1120 in any location along which safety switch 1120 is present. As many well-known configurations for safety switches, including use of mechanical contact switches, pressure sensors, light beams, acoustic signals, radar, sonar, etc. are all possible, safety switch 1120 as shown in FIG. 11B is only one possible embodiment representative of many well-known methods to detect foreign objects so that a system may react to them in the interest of safety.

FIGS. 8A-8C provided three embodiments for how a motor 802 may engage a jackscrew 800 so that the motor 802 may rotate and possibly measure torque required to turn the jackscrew 800. With the descriptions of FIGS. 9-11B, it is now clear how a coupling involving a T-coupler 804 and yoke 806, or a coupling involving a first wheel 816 and second wheel 818, may be beneficial as they allow a gantry moving along a row of jackscrews 800 to engage those jackscrews 800 in a simple and effective way, so that an electronically controlled slat bed 100 may operate beneficially. With the descriptions of FIGS. 8A-11B, those skilled in the art will recognize how various gantry configurations and techniques for coupling a motor to a jackscrew may be achieved. Those skilled in the art will recognize that embodiments in which a motor 802 coupled to an gantry selectively engages jackscrews or other suitable mechanisms involving gears, worm gears, bevel gears, splines, wheels, yokes, T-couplers, levers, clutches, magnetic couplers, magnetic gears, electric clutches, electro-mechanical mechanisms, and other forms or configurations of engagement mechanisms are possible in various embodiments.

With the descriptions of FIGS. 9-11B provided and the information in those figures, it is clear how gantries may be applied in electronically controlled slat beds 100. Various configurations of gantries may allow multiple struts to be engaged, measured for their weight load, and adjusted in height. As struts may be coupled with slats, head platforms, foot platforms, guards, and possibly other structures in an electronically controlled slat bed, measurement and control of struts will allow many aspects of an electronically controlled slat bed 100 to be monitored, measured, and adjusted. The embodiments shown in this patent application all make use of jackscrews 800 and electric motors to position and control gantries and to adjust strut height. Those skilled in the art will recognize that pneumatic motors, pneumatic cylinders, hydraulic motors, hydraulic cylinders, mechanisms (perhaps involving levers, gears, cams, etc.), and other commonly known techniques may be applied to raise and lower struts and/or slats in various embodiments of electronically controlled slat beds 100.

The embodiments of gantries and other elements in FIGS. 9-11B may be exposed to water, urine, or other fluids that may be spilled or expelled on an electronically controlled slat bed 100. Hence, some embodiments of electronically controlled slat bed 100 may benefit from use of sealed motors that are water-proof, water-proof electrical insulation, shielded electronic enclosures that are water-proof or provide shielding from water, electrically insulating couplings between motors and jackscrews (such as electrically insulated yokes and/or T-couplers, or other forms of couplings), electrically insulating struts and/or slats, fuses, circuit breakers, ground fault interrupters, and other design techniques and elements to provide electrical safety. It is noted that a key benefit of the teaching of this patent application is the use of a sensor mounted to a gantry to sense weight load on a plurality of struts as the gantry is moved. Utilizing this technique avoids the need for electrical wiring of sensors mounted on struts, jackscrews, or other structures that may be present in some embodiments, and provides electrical isolation between the slats and struts of a bed, and the sensing and control electronics needed for operation of the bed.

It is noteworthy that the teachings of this patent application includes monitoring the weight load and weight distribution on a bed through sensors coupled to struts so that electronic sensing is physically separated from close contact with a human bed occupant. These techniques allow conventional sensing technology to be utilized. In contrast, sensing technology that involves pressure sensing pads placed on the surface of mattresses must deal with issues including body fluids, contamination, human electrical safety, the need to provide airflow to the bed occupant, and other complicating factors.

As gantry 1000 may need to move to a pre-determined position before a given flexure 1100 can be measured (by measuring the distance from flexure sensor 1106 to flexure target 1104), some embodiments of electronically controlled slat beds 100 may benefit from a control scheme in which the gantries 1000 are normally parked in a position to measure changes in the force on struts 106 that are most likely to indicate force changes representative of changes in the sleeping position of a bed occupant. That is, once a graphical view of force measurements 700 or similar analysis has been undertaken, so that the position of a bed occupants hips, shoulders, and other major body parts has been estimated, the gantries 1000 in a bed may be positioned to monitor the flexures 1100 corresponding to the struts and slats supporting the major body parts. For example, if the gantries are parked and substantially continuously monitor the struts 106 supporting a slat 106 under a bed occupant's hips, if the bed occupant moves or significantly changes position, this may be sensed without moving the gantries 1000 (reducing noise and wear, and conserving power). And as most persons must move their hips to make a major change in sleeping position, this allows a bed to determine when a sleeping position may be changing so that force levels on additional struts may be measured and the sleeping surface optimized. For an embodiment of a bed in which two single bed-side gantries 1000 are used, each on one side of the bed, it may be beneficial to park one gantry to measure one of the struts of a slat under a bed occupant's hips, and the other gantry to measure one of the struts of a slat under the bed occupant's shoulders. As it would be difficult for a bed occupant to move their hips, for example, without changing the force they apply to both struts coupled to a slat under their hips, only one strut need be monitored to monitor motion of the bed occupant. Hence, electronically controlled slat beds 100 comprising multiple gantries 1000 may use those gantries to each monitor a strut 104 coupled to a different slat 104. It is noteworthy that measurement of force on struts may be monitored to measure the heart rate and/or breathing rate of a bed occupant in addition to force they may apply due to their sleeping position and skeletal movements. Hence, gantries 1000 may be applied to monitor forces on slats/struts near a bed occupant's chest so that heart rate and/or breathing rate may be determined. In some embodiments, changes in force on struts through the course of a breath of air by a bed occupant may be used to determine the strength of the breadth, and hence, estimate relatively the amount of air transferred, and/or determine if labored breathing is occurring. Information on heart rate, breathing rate, motion through the course of a night, the strength of breathing, and other information may be used to provide information to a bed occupant (in the morning) or to caregivers for the bed occupant, regarding the bed occupant's health and/or quality of sleep. Heart rate and/or breathing may also be monitored to indicate the sleep cycles of a bed occupant and the bed's sleeping surface may be adjusted in response to them.

Some bed occupants may move their legs or arms without substantially moving their hips or shoulders, making it hard to optimize a sleeping surface for them if only hips or shoulders are monitored. Hence, some embodiments may make scans of flexure targets 1104 at some intervals of time in an attempt to learn if a bed occupant is regularly moving their legs, arms, or other smaller body parts. And once an embodiment learns the sleeping habits of a bed occupant, it may optimize where gantries are parked to monitor occupant motion so that a more beneficial control may be provided for the bed occupant.

As the struts 106 of a bed 100 are raised or lowered, it is possible that blankets or sheets over a bed occupant may snag on the outside of bed frame 102, on slats 104, or even on other furniture or fixtures that may be close by a bed 100 (this was previously discussed briefly with regard to FIG. 11B). And while minor snags of blankets or sheets would not pose a problem, it is possible in some unlikely situations, that a snagged blanket or sheet could cause strangulation or other harm to a bed occupant. Hence, some embodiments of electronically controlled slat bed 100 may monitor forces on struts 106 as they are elevated and/or lowered, to ensure that the weight load on struts 106 is within an anticipated range (given the weight on the strut before it is raised/lowered and the anticipated additional weight that may be transferred to it as it is raised/lowered) and to reverse motion if a sudden or unexpected additional weight load is sensed. For such embodiments that sense flexure deflection to determine force, it may be beneficial for flexure target 1104 to be positioned relative to bearing support member 920 so that flexure sensor 1106 is properly positioned to measure the distance to flexure target 1104 when position sensor 912 indicates that gantry 1000 is positioned to rotate the jackscrew 800 to which the given flexure target 1104 is associated, so that a strut 106 being adjusted may have its weight load monitored as it moves. Monitoring of a bed occupant's breathing and heart rate as struts 106 in a bed 100 are adjusted may also be used as indications of whether a bed occupant is being injured by snagged blankets or sheets, so that appropriate actions may be taken (such as sounding an alarm, reversing motion of a strut being adjusted, etc.). And as was previously discussed with regard to FIG. 11B, some embodiments may monitor the weight load on multiple struts during adjustments of strut height, to provide additional information that may be used to ensure a bed occupants' safety.

Monitoring of flexures 1100 with flexure sensors 1106 in electronically controlled slat beds 100 may also be utilized to monitor signals from a bed occupant. For example, if a gantry is parked so that a flexure sensor near a bed occupants hips is monitored, the bed occupant may bump, tap, or bang the surface of the electronically controlled slat bed 100 so that a nearby flexure sensor 1106 may sense a pulse or other abrupt change in force so that the electronically controlled slat bed 100 may detect a signal and respond to a bed occupant. For example, a rapid banging detected from a bed occupant may signal that something is wrong and the bed should cease adjustment of struts; or possibly reverse motion and move struts to a lower position to relax force on a bed occupant's body. Other signals may include a given number of bumps delivered in succession to signal the bed to elevate the bed occupant's head, cause a rocking motion, move from one sleeping position to another, or other signals a bed occupant may wish to deliver to a bed. The meaning of a signal from a bed occupant, delivered to a bed through a sequence of one or more momentary applications of pressure to the bed's sleeping surface, may convey meaning through the timing of the sequence, the number of momentary applications of pressure applied in the sequence, the length of time the momentary application of pressure is applied, where on the bed surface the momentary application of pressure is applied, or in any other manner in which a sequence of momentary applications of pressure may convey a command to a bed. Those skilled in the art will recognize that many configurations of signals and their meanings and applications may be provided in various embodiments. Additionally, it is also possible to add additional sensors to an electronically controlled slat bed 100 to sense vibration, force, motion, or other parameters to respond to a bed occupant's signals, to monitor the occupant, and help to ensure their comfort and safety. And, of course, an electronically controlled slat bed 100 may also interface with a bed occupant through a conventional electronic interface such as a keyboard, touch screen, buttons, voice responses, etc. or through a device coupled through a wired or wireless electronic interface such as a cell phone, electronic watch, computer, or other device a bed occupant may use to send signal to and/or receive information from a bed.

FIG. 11C shows a flow chart 1150 of an embodiment of a control routine showing how a bed's gantries may be utilized for monitoring a bed and/or bed occupant when they are not actively adjusting the bed's surface shape. Operation of the bed begins with the start box 1152 indicating initiation of the bed's operation. From the start box 1152, operation flows to initialization box 1154 where operations such as system self-tests, initializations, initial calibrations, and other initial operations may take place in various embodiments. Initialization box 1154 may also collect information from a bed's sensors and may include adjustment of struts to generate an initial sleeping surface shape for a bed occupant. Control then moves from initialization box 1154 to gantry monitoring box 1156. Gantry monitoring box 1156 positions the gantries of a bed to beneficial positions for monitoring a bed occupant. The bed occupant's vital signs (breathing, heart rate, etc.), motion of the bed occupant, signals from the bed occupant, or other information that a bed may collect through sensing struts located so that the gantries may sense them from where they are parked by gantry monitoring box 1156 may be collected. Of course, some embodiments may include additional sensors and collect and act on information collected from them as well. Gantry monitoring box 1156 may also, at times, initiate scans of the weight load on some or all of the struts in a bed (via monitoring spring/flexure deflection or possibly using other sensing techniques). And in the course of monitoring a bed, gantry monitoring box 1156 may detect motion, signals, or conditions that indicate that an adjustment of the bed's struts and slats may be beneficial. In such a situation, adjustment decision box 1160 would then transfer control to bed adjustment routine 1158. And once a position adjustment is completed, or if no position adjustment is determined to be needed by adjustment decision box 1160, control would pass via control return path 1162 to gantry monitoring box 1156. Those skilled in the art will recognize that flow chart 1150 provides only a basic example of a possible scheme for controlling gantries and that may variations and different embodiments are possible.

FIG. 12A shows a side view of four embodiments of jackscrews 800 each mounted to a flexible apparatus that may be measured to provide an indication of force on the strut 106 coupled to a given jackscrew 800. Numbered elements in FIG. 12A have the same function as those so numbered in previous figures. Top support member 1030 is shown with smooth ends 812 of jackscrews 800 fitted into top bushing holes 1042 including bushings 1222. Bushings 1222 are shown in a dashed line outline as they are embedded inside top support member 1030. Bushings 1222 may be bushings of plastics, brass, other metals, other suitable materials or may be replaced with bearings that allow both rotational and thrust (up and down) motion of jackscrews 800. Bearing support member 920 is shown supporting each of the jackscrew 800 flexible support embodiments.

The left-most embodiment shows flexure 1100, flexure support 1102, and flexure target 1104 as were shown in FIGS. 11A and 11B and they are repeated in FIG. 12A for reference. The left most embodiment in FIG. 12A also includes stop block 1230 which may be a block of rigid, semi-rigid, or compliant material affixed to bearing support member 920, that may serve to stop motion of flexure 1100 if an excessive load is applied to flexure 1100. Stop block 1230 may be fabricated from wood, metal, plastics, rubber, or other materials, and may be designed so that it limits travel of flexure 1100 so that flexure 1100 is not overstressed and damaged due to excessive loads. In some embodiments, stop block 1230 may be secured to flexure 1100 and limit travel when it strikes bearing support member 920. Stop blocks 1230 are not shown in other embodiments of flexures supporting jackscrews in this patent application, but those skilled in the art will recognize that they may be easily incorporated into all embodiments shown using similar techniques to that shown for stop block 1230 in FIG. 12A.

The next embodiment (second from the left in FIG. 12A) shows a flexure with a thinned section 1202 and adds a coil spring 1200 under where bearing 812 is mounted and coiled around jackscrew 800. Utilizing a coil spring 1200 and a weakened and more flexible flexure simply shows that both leaf/bar style springs and coil springs may be applied to provide the function of a flexure.

The next embodiment (second from the right in FIG. 12A) shows an extended flexure 1101 extending between flexure supports 1102 on either side of jackscrew 800 and a coil spring coiled around jackscrew 800 and supporting extending flexure 1101 near the middle of its span. Clearly, it would also be possible to not include the coil spring from this embodiment and apply only the extended flexure 1101. Use of extended flexure 1101 may benefit some embodiments in keeping bearing 810 aligned to jackscrew 800 as extended flexure 1101 flexes in response to applied weight loads. Flexures 1100 as shown in FIGS. 11A-12A (and integrated flexure 1250 shown in FIG. 12B), may have somewhat limited range for flexing as bearing 810 may bind and no longer operate smoothly as jackscrew 800 becomes misaligned to bearing 810 due to tilting of bearing 810 as flexure 1100 flexes. Those skilled in the art will recognize that the amount of free motion allowing bearing 810 and flexure 1100 to tilt relative to the shaft orientation of jackscrew 800 is a design choice involving the design of bearing 810, and the design and range of flexing of flexure 1100 that is utilized in a given embodiment. Some embodiments may incorporate self-aligning bearings, bearings mounted in self-aligning mountings (such as pillow blocks and other possible mountings), retainers that may pivot relative to a bearing, bearings with spherical outer races mounted in spherical mounts allowing them to pivot, and other well-known techniques to allow a bearing to pivot or tilt relative to a shaft it is supporting. It is noted that bearing 810 as shown in FIGS. 8A-12A is shown as a flange mounted bearing utilizing a commonly available flanged outer race, however, bearings mounted in all possible kinds of mounts including pillow blocks, plastic mountings, self-aligned mountings, compressive flanges, welds, adhesives, and all other possible ways to mount a bearing to a flexure or bearing support member may be utilized in various embodiments.

The final embodiment shown in FIG. 12A (far right in the FIG. 12A) shows only a coil spring 1200 supporting a shortened support member 1103 instead of a flexure to support bearing 810 and flexure target 1104. This embodiment also includes an additional bushing 1224 mounted in bearing support member 920 as there is only limited lateral support of bearing 810 from coil spring 1200, hence, an additional bushing is beneficial to avoid wobbling of jackscrew 800 when yoke 806 is rotated, while allowing vertical motion of jackscrew 800.

The embodiments of FIG. 12A made clear that many embodiments of springs and/or flexures supporting bearings that, in turn, support jackscrews are possible. It is noteworthy that embodiments in which jackscrews are supported by bearings affixed to flexures supported on top support member 1030 are also possible. Such embodiments may include flexures 1100 mounted on top of top support member 1030 with bushings 808 affixed to jackscrews 800 near the top ends of jackscrews 800 so that bearings 810 mounted to flexures 1100 may support jackscrews 800. Bushings 1222 may then be applied to a lower member used in place of bearing support member 920 to guide the lower ends of jackscrews 800 (since, in such an embodiment, the bearings would actually be supported by top support member 1030) and allow jackscrews to both rotate and move up and down (through action of the flexures supporting them and mounted to top support member). A motor drive and jackscrew engagement technique similar to that shown in FIGS. 8B and 8C may be beneficial for such an embodiment of an electronically controlled slat bed 100 as a gantry may support motor 802, move alongside top support member 1030, and selectively engage jackscrews 800, driving them near their top end; alternatively, jackscrews 800 may continue to be driven from below as shown in FIGS. 9-11B but with flexures and bearings near the top ends of jackscrews 800. Many configurations of jackscrews coupled to flexures and/or springs so that forces may be measured while jackscrews may provide motion for bed adjustments are clearly possible.

FIG. 12B shows a perspective view of an embodiment of a portion of a bearing support member 920 in which integrated flexures 1250 are formed directly in bearing support member 920 and serve the same purpose as flexures 1100 already described. Numbered elements in FIG. 12B have the same function as those so-numbered in previous figures. In the embodiment of bearing support member 920 shown in FIG. 12B, integrated flexures 1250, strut holes 1028, and bearing holes 1026 may be formed in bearing support member 920 through cutting, machining, laser cutting, water jet cutting, drilling, or similar processes; or bearing support member 920 may be molded, formed, or cast, using a die casting, injection molding, or other suitable process. Integrated flexure 1250 is formed of the same material as bearing support member 920 and is separated on three of its sides from bearing support member 920 so that it may deflect responsively to weight applied to a bearing 810 mounted in bearing hole 1026, in a similar fashion to the function of flexure 1100 as shown in FIGS. 11A-12A. Flexure kerf 1252 shown in FIG. 12B represents the open space around three sides of integrated flexure 1250 that separates the moving portions of integrated flexure 1250 from the substantially non-moving portions of bearing support member 920. The embodiment of bearing support member 920 in FIG. 12B may be formed from steel, stainless steel, aluminum, other metals, wood, plastics, combinations of materials, or other suitable materials. The embodiment of FIG. 12B, for the sake of simplicity, does not include gantry guiding rails, track recessions, or other elements that may be useful for guiding a gantry or for mounting and supporting bearing support member. Those skilled in the art will recognize that additional machining, forming, the application of additional elements, or other techniques may be applied to the embodiment of bearing support member 920 as shown in FIG. 12B to further enhance its ability to support and be sensed by a gantry, or provide other beneficial functions.

Flexing of integrated flexure 1250, responsive to weight load applied to bearing hole 1026 (through a bearing 810 and jackscrew 800 coupled to bearing hole 1026 as would be present in an embodiment of a bed utilizing the embodiment of FIG. 12B) may be measured through use of a flexure sensor 1106 as shown in and explained with regard to FIGS. 11A-11B. Flexure targets 1104 are not shown in FIG. 12B as it is assumed that a flexure sensor 1106 may measure directly to the surface of integrated flexure 1250 to determine the deflection of integrated flexure 1250. Of course, embodiments including flexure targets 1104 are also possible for embodiments of beds utilizing integrated flexures 1250.

Most springs and spring materials, whether formed into a coil spring, leaf spring, or other configuration, age and eventually sag over time and use. Hence, it is possible for flexure 1100, integrated flexure 1250, and the other flexure/spring functions shown in FIGS. 11A-11B and FIGS. 12A-12B to age and/or sag so that measurement of the distance to flexure target 1104 from flexure sensor 1106, or a reading of strain gauge 1254, no longer provides an accurate measurement of the force applied to a strut 106 and jackscrew 800. This issue may be addressed in some embodiments by a calibration of the flexure measurements by simply measuring the distances from flexure sensor 1106 to each flexure target 1104, or the reading value of strain gauge 1254, while no load is present in a bed and then using these no-load baseline positions as a point of calibration. Multiple point calibrations using known weight loads are also possible. As such calibrations of the embodiments of flexures/springs that have been provided, or other possible embodiments of flexures/springs used to support struts 106 are analogous to very well-known techniques commonly applied for the calibration of weight scales, they will not be further described. It is noted that in some embodiments, flexures 1100, integrated flexures 1250, or other springs/flexures that may be utilized may be replaceable if they age or sag over time. In such embodiments, application of calibration routines as described may indicate that some or all of the flexures/springs of an electronically controlled slat bed 100 need replacement and the need for such replacement may be indicated to a bed occupant, operator, or other person calibrating a bed.

FIGS. 11A-11B and FIGS. 12A-12B make clear that there are many possible embodiments for supporting a jackscrew with a flexible apparatus that responds to weight or force and can be sensed to assess the applied weight or force; and hence, an applied weight load. Flexures, integrated flexures, springs, and other possible mechanisms, couplings, or mountings offering similar capability that are responsive to weight load, offer benefit in allowing a sensor coupled to a gantry to monitor the weight load applied to a plurality of jackscrews, struts, and/or slats. This offers considerable benefit as it very significantly reduces the number of sensors in a bed; which reduces costs, improves consistency of measurements, improves reliability, improves ease of making repairs, and potentially offers additional benefits. Those skilled in the art will recognize that many embodiments are possible for a flexible apparatus that may serve the function of a flexure and/or spring as described herein including use of all manner of coil springs, leaf spring, torsion springs, mechanisms coupled to springs, mechanisms coupled to flexures, and other possible configurations of springs and/or flexures. And such springs and/or flexures may be formed from spring steel, steel, stainless steel, other metals, plastics, fiberglass, other elastic or compliant materials, wood, laminations of materials, combinations of materials, or other possible materials. Similarly, flexures, springs, and mountings for flexures and/or springs may be formed into various embodiments of bearing support members that are formed from die cast metals, molded plastics, formed metals, machined materials, composite materials, combinations of materials, or materials fabricated in other beneficial ways. Flexures and/or springs may be coupled to jackscrews and bearings using a wide variety of mountings that may including mounting blocks, pillow blocks, self-aligned couplings, guide pins, guiding levers, guide bushings, axles, pivots, levers, or other possible techniques.

In the embodiments shown in FIGS. 11A-11B and FIGS. 12A-12B, the weight load or force applied to a slat or strut is sensed by taking distance measurements to assess the degree of deflection of the flexure or spring. However, some possible embodiments may utilize other techniques to determine weight load applied to a slat or strut. For example, an embodiment of flexure 1100 may be sensed by monitoring the angle at which a laser light directed to flexure target 1104 is reflected, providing an indication of the level of deflection of flexure 1100 (that is, the degree of deflection of flexure 1100 may be determined by measuring the degree to which the orientation of flexure target 1104 changes as flexure 1100 deflects in response to a weight load). In other embodiments, flexure 1100 may be formed from a substantially transparent material that becomes somewhat opaque when it is deflected, so the level of light transmission through the material becomes an indication of weight load. Still other embodiments may make use of materials, mountings, mechanisms, couplings, or other structures that alter their optical, magnetic, electrical, acoustic, shape, orientation, or other properties in response to applied forces. Most materials, mountings, mechanisms, couplings, or other structures will deflect or deform at least slightly under an applied load, so for the purposes of this patent application, an element supporting a strut or slat that responds to weight or pressure applied to the strut or slat will be considered a flexible apparatus and its response to the weight or pressure will be considered a deflection. And in some embodiments, it may be beneficial to sense/measure changes in an optical, magnetic, electrical, acoustic, shape, orientation, or other property of a material, mounting, mechanism, coupling, or other structure in response to an applied weight load, than to measure deflection through a distance measurement. As the teaching of this patent application includes a sensor mounted to a gantry that allows measurements to be taken of a weight load applied to a strut or slat by positioning the gantry to sense the weight load applied to that strut or slat, those skilled in the art will recognize that embodiments including use of materials, mountings, mechanisms, flexible apparatuses, couplings, or other structures that change their optical properties, electrical properties, magnetic properties, electromagnetic properties, physical dimensions, shape, orientation, acoustic properties, or any other aspects or properties in response to weight load applied to a strut or slat, and that may be measured through a sensor coupled to a gantry that is responsive to those changes in properties, are possible embodiments that are taught by this patent application.

FIG. 13 shows a side view of an embodiment of a tilting head platform 1300. In FIG. 13, head platform 110, as shown previously, is mounted to hinged plates 1308 including hinge axle 1306. Hinged plates 1308 are supported by angled support 1304 and vertical support 1302. In the embodiment shown, angled support 1304 and vertical support 1302 form a mounting apparatus for tilting head platform 1300, those skilled in the art will recognize that many possible embodiments for a mounting apparatus may be utilized in various embodiments of electronically controlled slat beds. Knob 112 is shown to indicate that tilting head platform 1300 may be mounted to an electronically controlled slat bed 100 in a similar fashion and be adjusted in height similarly to head platforms 110 shown in prior figures. Referring back to FIG. 1C, it is clear that a bed occupants hands, arms, head or other body part may be inserted between bed covering 118 and head platform covering 120 near where head platform 110 is adjacent to a nearest slat 104. If such a situation occurred, and slats 104 near head platform 110 were raised automatically, it may be possible to injure the bed occupant. Tilting head platform 1300 addresses this possible issue by allowing head platform 110 to tilt forward so that any pressure between head platform 110 and nearby slats 104 would not crush or otherwise injure a bed occupant. Those skilled in the art will recognize many possible enhancements to tilting head platform including use of hinges with limited range of rotation, use of cushioning under the bottom side of head platform 110 to further enhance safety, use of springs or elastic to gently hold head platform 110 down so that it doesn't spring up due to normal movement of a bed occupant, use of breakaway mountings and materials so that vertical support 1302 and/or angled support 1304 break away to avoid injury if too much pressure builds on tilting head platform 1300, application of bumpers or felt bushings between hinge plates 1308 to cushion them in normal operation, and other possible enhancements.

It is noted that the teachings of this patent application focused on novel techniques for the construction of electronically controlled slat beds 100, and possibly other types of beds that may benefit from the techniques described herein. Those skilled in the art will recognize that these teachings may be similarly applied to the construction of sofas, love seats, chairs, lounges, benches, cots, and other furniture that may benefit from these teachings.

Those skilled in the art to which the present disclosure relates will appreciate that other and further additions, deletions, substitutions, and modifications may be made to the described embodiments.

I claim:

1. An electronically controlled slat bed comprising:
a bed frame;
a plurality of slats together at least partially forming a base for a sleeping surface;
a plurality of struts, each of the plurality of struts coupled to at least one of the plurality of slats, and each of the plurality of struts coupled to said bed frame;
a plurality of jackscrews, each coupled to at least one of the plurality of struts and configured to adjust the coupled strut;
a plurality of flexible apparatuses each coupled to one of said plurality of jackscrews;
a gantry coupled to said bed frame, the gantry having: an electric motor; and
a sensor;
wherein the motor is configured to engage and rotate at least a subset of the plurality of jackscrews; and
wherein said sensor is configured to provide a measurement of a deflection of the plurality of flexible apparatuses; and
an electronic controller, having:
an input configured to receive signals from the sensor; and one or more outputs to control said electric motor;
wherein said electronic controller performs computations at least partially responsive to said measurement of the deflection of said flexible apparatuses and modifies the shape of said base for the sleeping surface by rotating one or more of the plurality of jackscrews; and
wherein the deflection of one of the plurality of flexible apparatuses is responsive to a weight load applied to one of the plurality of jackscrews coupled to one of the plurality of flexible apparatuses.

2. The bed according to claim 1, wherein each of the plurality of flexible apparatuses is a spring.

3. The bed according to claim 1, wherein each of the plurality of flexible apparatuses is a flexure.

4. The bed according to claim 1, wherein said measurement of the deflection is a measurement of distance between a first point on said gantry and a second point on one of the plurality of flexible apparatuses and is determined by said sensor.

5. The bed according to claim 1, wherein said measurement of the deflection is a measurement of a physical property of one of said plurality of flexible apparatuses, determined by said sensor.

6. The bed according to claim 5, wherein said physical property is at least one of a set of properties including optical properties, physical dimensions, shape, orientation, magnetic properties, electromagnetic properties, acoustic properties, or electrical properties.

7. The bed according to claim 1, wherein said measurement of the deflection may be undertaken while said gantry is either in motion or stationary.

8. The bed according to claim 1, wherein said bed frame further comprises:
a first side; and
a second side;
wherein said plurality of flexible apparatuses are formed by a cutting process into a member; and
wherein the member is coupled to said first side or said second side of said bed frame.

9. The bed according to claim 1, wherein said gantry further comprises:
one or more additional sensors; and
wherein the gantry is configured to measure deflections of more than one of the plurality of flexible apparatuses, coupled to one or more of the plurality of jackscrews, at a given time.

10. The bed according to claim 1, wherein said electronic controller further comprises:
an interface over which said electronic controller receives information from at least one of a computer network, a computer, or a personal electronic device.

11. The bed according to claim 1, wherein each of said plurality of slats comprises:
an upper member coupled to a lower member; and
wherein the coupling allows the upper member to pivot with respect to the lower member.

12. The bed according to claim 1, further comprising:
a bed covering applied over said plurality of slats and secured to at least a subset of said plurality of struts.

13. The bed according to claim 1, wherein at least a subset of said struts are constructed and spaced so that, taken together, they form a barrier that reduces the ability of a person to extend a body part through said barrier.

14. An electronically controlled slat bed comprising:
a bed frame;
a plurality of slats together at least partially forming a base for a sleeping surface;
a plurality of struts, each of the plurality of struts coupled to at least one of the plurality of slats and to said bed frame;
a first gantry, coupled to said bed frame, said gantry having:
an electric motor; and
a sensor;
wherein said motor is configured to engage and adjust at least a subset of said plurality of struts; and
wherein said sensor is configured to provide a measurement of a weight or pressure applied to one of the plurality of slats;
an electronic controller, having:
an input configured to receive signals from said sensor; and
one or more outputs to control said electric motor; and
wherein during a first time interval, said electronic controller controls said first gantry to a position in which said sensor is responsive to skeletal movements of a bed occupant; and
wherein each of the plurality of struts is individually adjustable so that a position of each of the plurality of slats may be adjusted.

15. The bed according to claim 14, wherein said sensor measures the deflection of a flexible apparatus to provide the measurement of a weight or pressure applied to one of the plurality of slats.

16. The bed according to claim 14, wherein during a second time interval, said first gantry is controlled to move substantially continuously and collect readings of said weight or pressure applied to at least a subset of said plurality of slats, while said first gantry is in motion.

17. The bed according to claim 14, wherein said position allows said sensor to monitor weight or pressure on a slat that is proximal the bed occupant's hips, shoulders, hands, or feet.

18. The bed according to claim 14, further comprising:

a second gantry;

wherein said electronic controller independently controls positions of each of the first gantry and the second gantry;

wherein a position of the first gantry allows the sensor on the first gantry to monitor weight or pressure on one of the plurality of slats that is proximal the bed occupant's hips, shoulders, hands, or feet; and wherein a position of the second gantry allows a second sensor on the second gantry to monitor weight or pressure on one of the plurality of slats that is proximal an area of the bed occupant's body different from the area being monitored by the sensor on the first gantry.

19. The bed according to claim 14, wherein said skeletal movement of the bed occupant comprises signals the bed occupant desires to send to the bed, and wherein the bed occupant delivers the signals through one or more momentary applications of force to the sleeping surface of the bed.

20. The bed according to claim 14, wherein each of said plurality of slats comprises: an upper member coupled to a lower member; and wherein the coupling allows the upper member to pivot with respect to the lower member.

21. The bed according to claim 14, wherein said electronic controller further analyzes signals from said sensor and at least partially determines estimates for vital signs of the bed occupant using said signals from said sensor, the determined vital signs being at least one of a set including heart rate, breathing rate, and activity level.

22. The bed according to claim 14, wherein at least a subset of said plurality of struts are constructed and spaced so that, taken together, they form a barrier that reduces the ability of a person to extend a body part through said barrier.

23. An electronically controlled slat bed comprising:

a bed frame;

a plurality of slats together at least partially forming a base for a sleeping surface;

a plurality of struts, each strut coupled to at least one of the plurality of slats and to said bed frame;

an electronic controller, having:

an input configured to receive signals from one or more sensors indicating a weight load on each of said plurality of slats; and one or more outputs to control said plurality of struts; and a head platform coupled to the bed frame by a mounting apparatus;

wherein said head platform is configured to hinge upwards on one side, or to break away from the mounting apparatus supporting it, if at least a predefined level of upward force is applied to the head platform; and wherein each of the plurality of struts is individually adjustable so that a position of each of the plurality of slats may be adjusted.

* * * * *